US010940597B2

(12) United States Patent
Park et al.

(10) Patent No.: US 10,940,597 B2
(45) Date of Patent: Mar. 9, 2021

(54) RAZOR CARTRIDGE HAVING A BLADE HOUSING WITH SLITS RECEIVING CLIPS FOR SECURING RAZOR BLADES

(71) Applicant: DORCO CO., LTD., Seoul (KR)

(72) Inventors: Semin Park, Seoul (KR); Kyongsik Lee, Seoul (KR); Jinwoo Jeong, Seoul (KR)

(73) Assignee: DORCO CO., LTD., Seoul (KR)

( * ) Notice: Subject to any disclaimer, the term of this patent is extended or adjusted under 35 U.S.C. 154(b) by 28 days.

(21) Appl. No.: 16/231,240

(22) Filed: Dec. 21, 2018

(65) Prior Publication Data

US 2019/0202076 A1 Jul. 4, 2019

(30) Foreign Application Priority Data

Jan. 2, 2018 (KR) ..... 10-2018-0000061

(51) Int. Cl.
*B26B 21/40* (2006.01)
*B26B 21/22* (2006.01)

(52) U.S. Cl.
CPC ..... *B26B 21/4018* (2013.01); *B26B 21/225* (2013.01); *B26B 21/227* (2013.01);
(Continued)

(58) Field of Classification Search
CPC . B26B 21/4018; B26B 21/225; B26B 21/227; B26B 21/4025; B26B 21/4012; B26B 21/4068
See application file for complete search history.

(56) References Cited

U.S. PATENT DOCUMENTS 3,783,510 A * 1/1974 Dawidowicz ..... B26B 21/222 30/47
5,687,485 A 11/1997 Shurtleff et al.
(Continued)

FOREIGN PATENT DOCUMENTS

EP 2853362 4/2015
JP 05501515 3/1993
(Continued)

OTHER PUBLICATIONS

Korean Intellectual Property Office Application No. 10-2018-0000061, Notice of Allowance dated May 15, 2018, 2 pages.
(Continued)

*Primary Examiner* — Ghassem Alie
*Assistant Examiner* — Fernando A Ayala
(74) *Attorney, Agent, or Firm* — Lee, Hong, Degerman, Kang & Waimey

(57) ABSTRACT

Provided is a razor cartridge having a new fixing clip mounting structure. Such a razor cartridge includes at least one razor blade having a cutting edge, a blade housing configured to accommodate the at least one razor blade in a longitudinal direction, which is perpendicular to a shaving direction, and a pair of fixing clips configured to secure both ends of the at least one razor blade to be seated in the blade housing, wherein the blade housing includes a pair of side slits which are disposed at a forward position with respect to the at least one razor blade and configured to be open at a side end of the blade housing, and each of the pair of fixing clips includes a first leg portion and a second leg portion, wherein for each of the fixing clips, the corresponding first leg portion is accommodated in a corresponding side slit of the pair of side slits and the corresponding second leg portion is wrapped around a rear end of the blade housing.

17 Claims, 29 Drawing Sheets

(52) U.S. Cl.
CPC ..... *B26B 21/4012* (2013.01); *B26B 21/4025* (2013.01); *B26B 21/4068* (2013.01)

(56) References Cited

U.S. PATENT DOCUMENTS

| | | | | |
|---|---|---|---|---|
| 5,761,814 | A | 6/1998 | Anderson et al. | |
| 5,956,848 | A | 9/1999 | Tseng et al. | |
| 5,956,851 | A | 9/1999 | Apprille et al. | |
| 6,041,926 | A | 3/2000 | Petricca et al. | |
| 6,052,903 | A | 4/2000 | Metcalf et al. | |
| 6,185,822 | B1 | 2/2001 | Tseng et al. | |
| 6,212,777 | B1 | 4/2001 | Gilder et al. | |
| 6,442,839 | B1 | 9/2002 | Tseng et al. | |
| 6,516,518 | B1 | 2/2003 | Garraway et al. | |
| 6,612,040 | B2 | 9/2003 | Gilder | |
| 6,684,513 | B1 | 2/2004 | Clipstone et al. | |
| 8,286,354 | B2 * | 10/2012 | Walker, Jr. | B26B 21/225 30/32 |
| 10,421,205 | B2 * | 9/2019 | Hodgson | B26B 21/165 |
| 2009/0188112 | A1 * | 7/2009 | Prochaska | B26B 21/4018 30/34.05 |
| 2011/0308089 | A1 * | 12/2011 | Bridges | B26B 21/4031 30/77 |
| 2016/0158948 | A1 * | 6/2016 | Eagleton | B26B 21/443 30/34.2 |
| 2016/0167242 | A1 * | 6/2016 | Noh | B26B 21/4031 30/50 |
| 2016/0354940 | A1 * | 12/2016 | Bozikis | B26B 21/4068 |
| 2017/0282388 | A1 * | 10/2017 | Haines | B26B 21/446 |
| 2017/0282389 | A1 * | 10/2017 | Jolley | B26B 21/4018 |
| 2018/0071929 | A1 * | 3/2018 | Walker, Jr. | B26B 21/4006 |
| 2019/0168402 | A1 * | 6/2019 | Efthimiadis | B26B 21/565 |
| 2019/0299464 | A1 * | 10/2019 | Washington | B26B 21/446 |

FOREIGN PATENT DOCUMENTS

| | | |
|---|---|---|
| JP | 2001518333 | 10/2001 |
| JP | 2011500169 | 1/2011 |
| JP | 201562670 | 4/2015 |
| JP | 2017506546 | 3/2017 |
| JP | 2017536947 | 12/2017 |
| KR | 100394824 | 11/2003 |
| KR | 1020100103458 | 11/2010 |
| KR | 101668230 | 10/2016 |
| KR | 101682481 | 12/2016 |
| KR | 1020177003880 | 3/2017 |
| WO | 1996010473 | 4/1996 |
| WO | 3916591 | 4/1999 |
| WO | 2017086514 | 5/2017 |

OTHER PUBLICATIONS

Korean Intellectual Property Office Application No. 10-2018-0000061, Prioritized Search Report dated Jan. 2, 2018, 7 pages.
European Patent Office Application Serial No. 18215942.6, Search Report dated May 17, 2019, 5 pages.
Japan Patent Office Application No. 2018-244252, Office Action dated Oct. 29, 2019, 4 pages.

* cited by examiner

RAZOR CARTRIDGE HAVING A BLADE HOUSING WITH SLITS RECEIVING CLIPS FOR SECURING RAZOR BLADES

Pursuant to 35 U.S.C. § 119(a), this application claims the benefit of earlier filing date and right of priority to Korean Patent Application No. 10-2018-0000061, filed on Jan. 2, 2018, the contents of which are hereby incorporated by reference herein in its entirety.

BACKGROUND

The present disclosure relates to a razor cartridge, and more particularly, to a razor cartridge having fixing clips for firmly seating a plurality of razor blades on a blade housing.

Generally, a conventional razor, which is known as a wet razor, includes a razor cartridge and a razor handle. Generally, the razor cartridge includes at least one razor blade disposed between a rear side of a guard bar and a front side of a cap and includes a blade housing for seating the blade. The razor cartridge is installed to be pivotable on the razor handle so that the razor cartridge is able to pivot, with respect to the razor handle, between a neutral position and a pivoting position during use of the razor. Generally, such pivoting motion is fundamentally performed about a rotation axis that is parallel to a direction in which the razor blade is disposed on the blade housing. In this way, since the razor cartridge is detachably disposed on the razor handle, a user may remove a razor cartridge with dull razor blades and mount a new razor cartridge on the razor handle for use when shaving afterwards.

Generally, a pair of fixing clips are used in order to firmly seat the razor blade on the blade housing. Specifically, the pair of fixing clips fix both side ends of a razor blade to the blade housing. In this way, in order to fix the blade housing using the pair of fixing clips, two legs included in each fixing clip should be able to surround a bottom surface of the blade housing.

In recent years, there has been proposed a structure in which two legs of fixing clips are fixed to a blade housing via a through-hole and a rear end of the blade housing, respectively. While the fixing clips surround both side ends of a razor blade, a first leg of the fixing clips passes through the through-hole, which is formed in front of the blade, in the vicinity of both side ends of the blade housing and is bent at a lower surface of the blade housing, and a second leg is bent at the lower surface of the blade housing while surrounding the rear end of the blade housing.

In such a razor cartridge, since the fixing clips pass through the through-hole without surrounding a front end of the guard bar, a sufficient width of the guard bar may be secured, and since the rear end of the blade housing is surrounded by the fixing clips, the structure of the blade housing is simplified and assembly is facilitated.

However, in reality, since a precise injection process is required in order to form a fine through-hole in the blade housing, there is a concern that a closed side end of the blade housing, in which the through-hole will be formed, will be at least partially damaged in the injection process, and complexity of a mold structure is increased in the injection process for forming the through-hole. In addition, in an assembly process of the conventional razor cartridge, the fixing clips may only be mounted in a direction perpendicular to a surface at which the blade housing is formed, and such a limited direction decreases the degree of freedom of the assembly process of the razor cartridge.

SUMMARY

Aspects of the present disclosure improve a structure of a blade housing which is coupled to fixing clips for blades to be stably fixed to the blade housing.

Other aspects of the present disclosure provide a sufficient allowable error without requiring an extremely high degree of precision in an injection molding process of the blade housing.

Still other aspects of the present disclosure improve the degree of freedom in a process of assembling the fixing clips to the blade housing.

It should be noted that objects of the present disclosure are not limited to the above-mentioned objects, and other objects of the present disclosure will be understood by those skilled in the art from the following descriptions.

To achieve the above objects, a razor cartridge according to an embodiment of the present disclosure includes at least one razor blade having a cutting edge, a blade housing configured to accommodate the at least one razor blade in a longitudinal direction, which is perpendicular to a shaving direction, and a pair of fixing clips configured to secure both ends of the at least one razor blade to be seated in the blade housing, wherein the blade housing includes a pair of side slits which are disposed at a forward position with respect to the at least one razor blade and configured to be open at a side end of the blade housing, and each of the pair of fixing clips includes a first leg portion and a second leg portion, wherein for each of the fixing clips, the corresponding first leg portion is accommodated in a corresponding side slit of the pair of side slits and the corresponding second leg portion is wrapped around a rear end of the blade housing.

BRIEF DESCRIPTION OF THE DRAWINGS

The above and other aspects and features of the present disclosure will become more apparent by describing exemplary embodiments thereof in detail with reference to the attached drawings, in which.

and

Figure 16A:
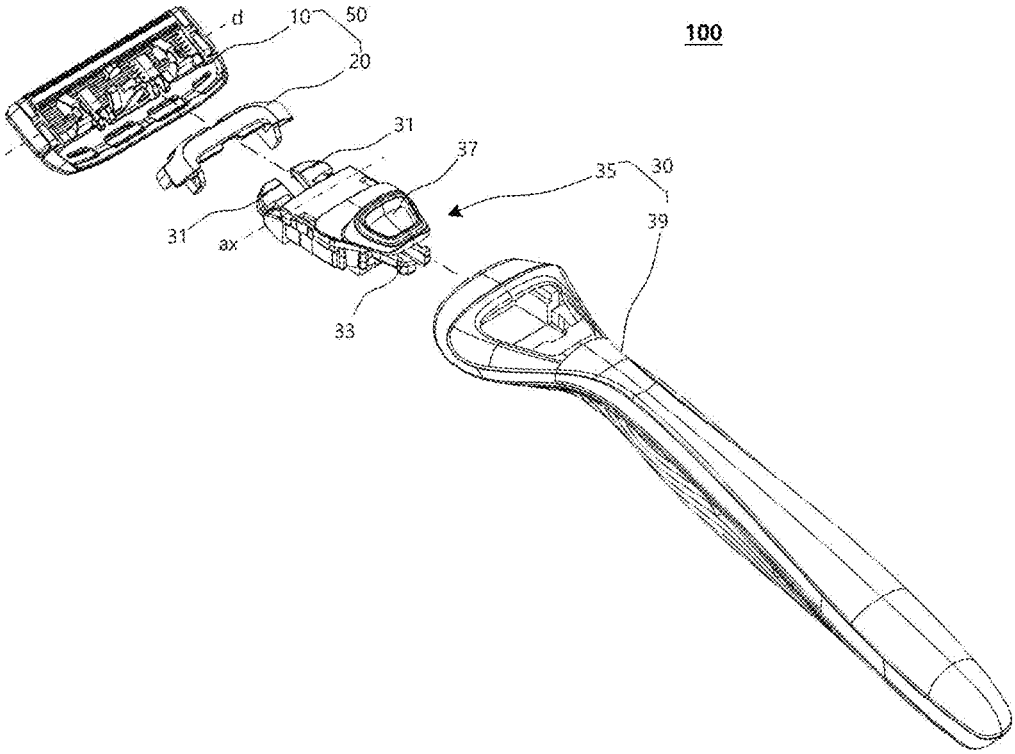
FIG. 16A is an exploded perspective view of a razor according to an embodiment of the present disclosure.
Figure 16B:
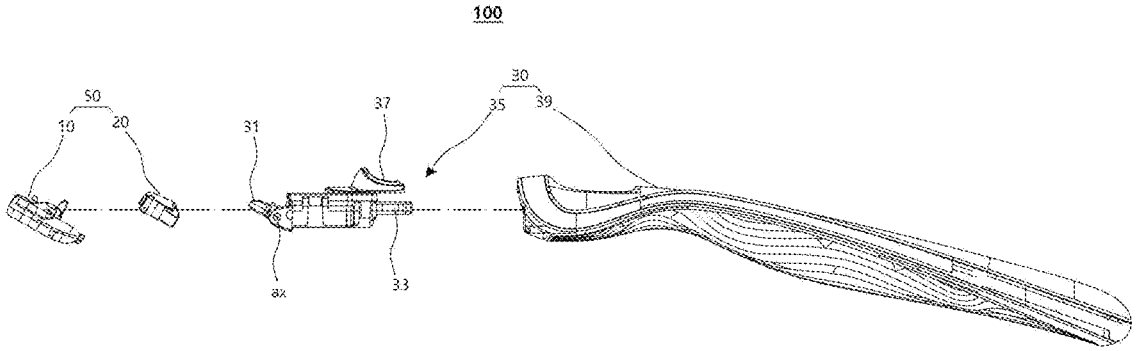
FIG. 16B is a side view of the exploded perspective view illustrated in FIG. 16A.
Figure 16C:
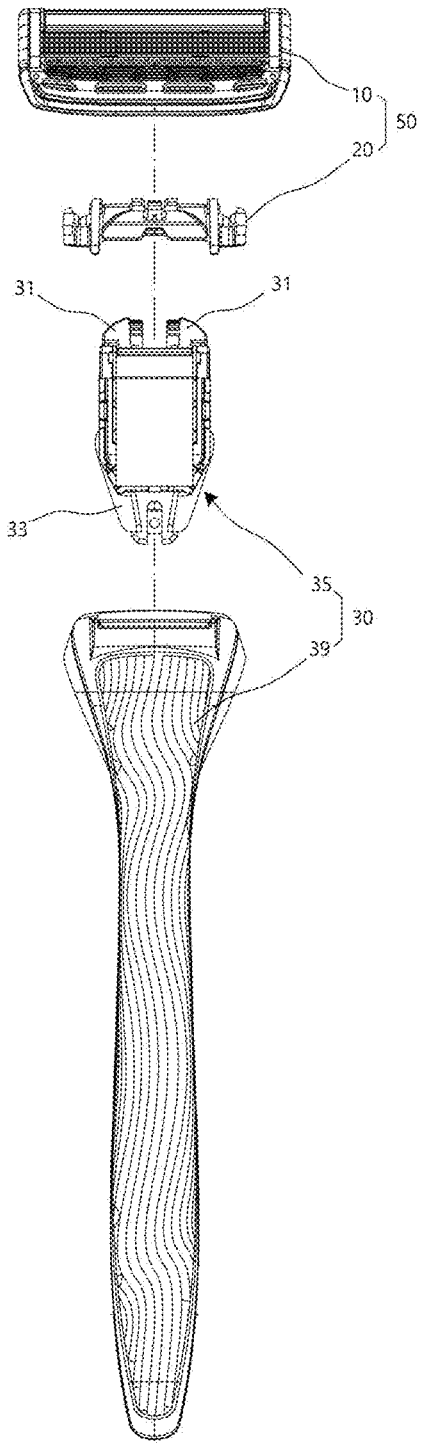

FIG. 16C is a plan view of the exploded perspective view illustrated in FIG. 16A.

DETAILED DESCRIPTION OF THE EMBODIMENTS

Advantages and features of the present disclosure and a method of achieving the same should become clear with embodiments described in detail below with reference to the accompanying drawings. However, the present disclosure is not limited to the embodiments disclosed below and may be realized in various other forms. The present embodiments make the disclosure complete and are provided to completely inform one of ordinary skill in the art to which the present disclosure pertains of the scope of the disclosure. The present disclosure is defined only by the scope of the claims. Like reference numerals refer to like elements throughout.

Unless otherwise defined, all terms including technical and scientific terms used herein have the same meaning as commonly understood by one of ordinary skill in the art to which the present disclosure pertains. Terms, such as those defined in commonly used dictionaries, are not to be construed in an idealized or overly formal sense unless expressly so defined herein.

Terms used herein are for describing the embodiments and are not intended to limit the present disclosure. In the present specification, a singular expression includes a plural expression unless the context clearly indicates otherwise. "Comprises" and/or "comprising" used herein do not preclude the existence or the possibility of adding one or more elements other than those mentioned.

Hereinafter, an embodiment of the present disclosure will be described in detail with reference to the accompanying drawings.

Figure 1A:
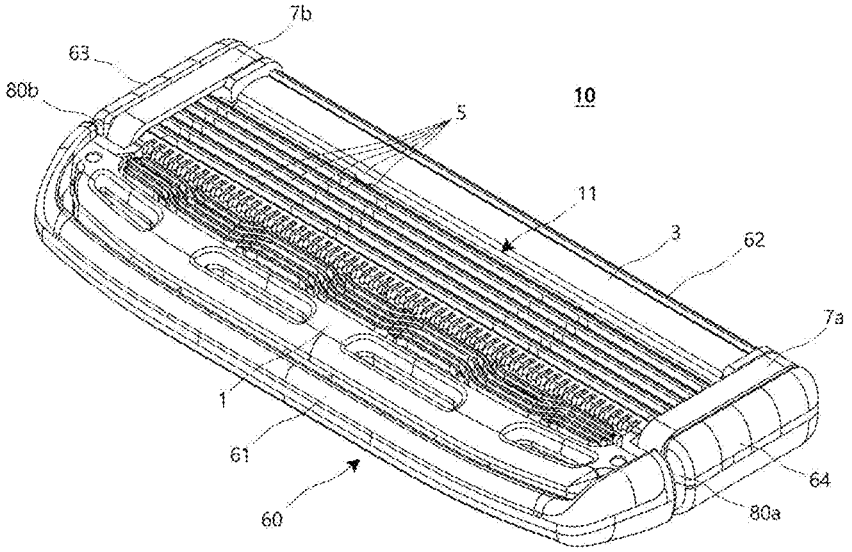
FIG. 1A is a perspective view of a razor cartridge according to an embodiment of the present disclosure.
Figure 1B:
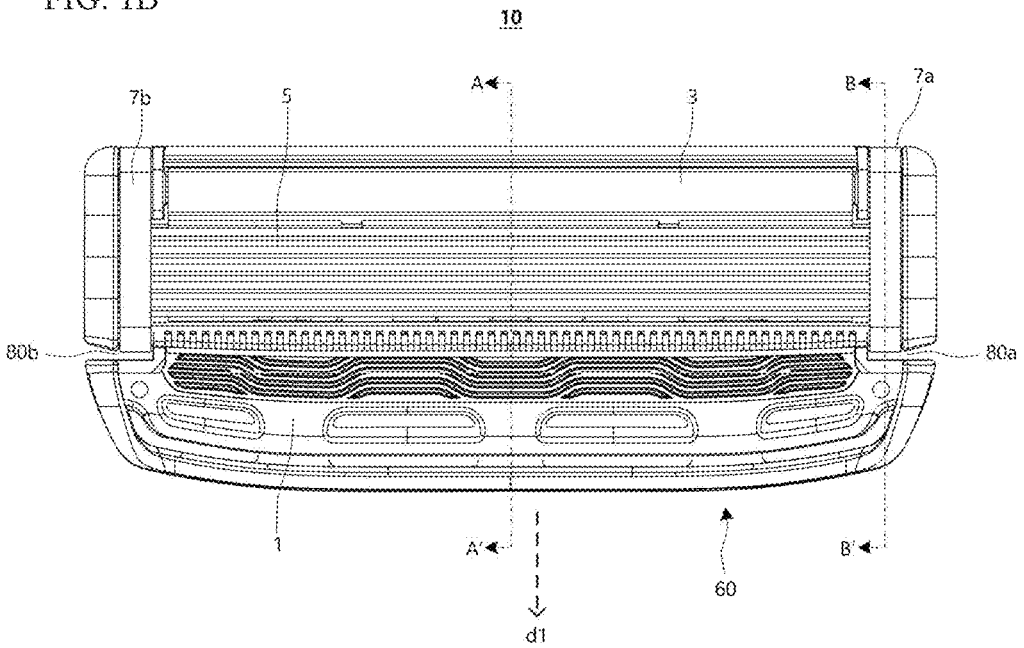
FIG. 1B is a plan view of the razor cartridge illustrated in FIG. 1A.
Figure 1C:
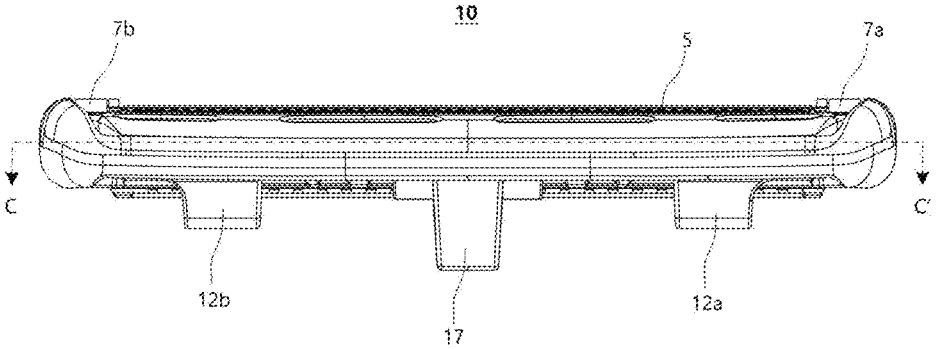
FIG. 1C is a front view of the razor cartridge illustrated in FIG. 1A.
Figure 1D:
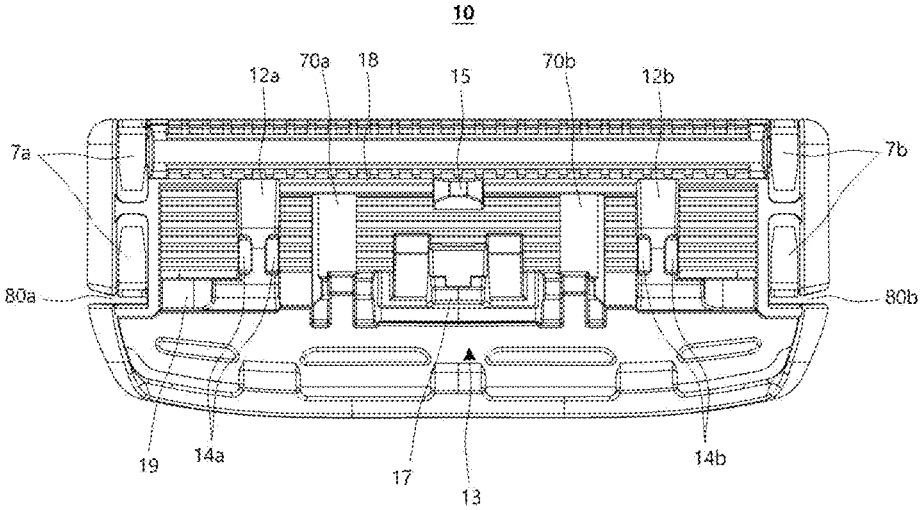
FIG. 1D is a bottom view of the razor cartridge illustrated in FIG. 1A.

FIG. 1A is a perspective view of a razor cartridge 10 according to an embodiment of the present disclosure, FIG. 1B is a plan view of the razor cartridge 10, FIG. 1C is a front view of the razor cartridge 10, and FIG. 1D is a bottom view of the razor cartridge 10. The razor cartridge 10 may include at least one razor blade 5 having a cutting edge, a blade housing 60 configured to accommodate the at least one razor blade 5, an elastic member 1 disposed at a front portion 61 of the blade housing 60, and a cap member 3 disposed at a rear portion 62 of the blade housing 60.

The elastic member 1 causes facial hair of a user to stand upright in a direction that is substantially perpendicular to a shaving direction d1 so that cutting facial hair by the razor blade 5 is facilitated. The elastic member 1 may be manufactured with a flexible material such as a synthetic resin, synthetic rubber, and natural rubber. In addition, the front portion 61 of the blade housing 60 is a portion that comes into contact with the user's skin first during shaving, and a front guard or a guard bar 2 (see FIG. 3A), which is integrally formed with the blade housing 60, may be disposed in the vicinity of the front portion 61. Although the elastic member 1 is usually attached or coupled onto the guard bar 2, embodiments are not limited thereto, and only the guard bar 2 may be present without the elastic member 1, or only the elastic member 1 may be formed in front of the blade housing 60 without the guard bar 2.

The cap member 3 disposed at the rear portion 62 of the blade housing 60 may include a lubrication band as a contact surface that is separated from the skin last during a shaving stroke. The lubrication band serves to soothe irritated skin after the cutting. Such a lubrication band may be formed of a flexible material, a porous material capable of absorbing moisture, or a shaving aid.

The razor blade 5 has a cutting edge 41 (see FIG. 2A) at one side, and the other side of the razor blade 5 may be seated on longitudinal end members 70*a* to 70*d* (see FIG. 4B) included in the blade housing 60. In this case, a single razor blade 5 or two or more razor blades 5 may be disposed, and a direction in which the razor blade 5 is aligned with the blade housing 60 is a longitudinal direction that is perpendicular to the general shaving direction d1. Such a razor blade 5 may be formed of stainless steel, metal alloys, ceramic, and/or various other materials and may be formed as an integral blade that is integrally formed through a bending process, or a large steel blade or a straight blade that is formed by attaching a blade edge portion onto a bent support.

Figure 2A:
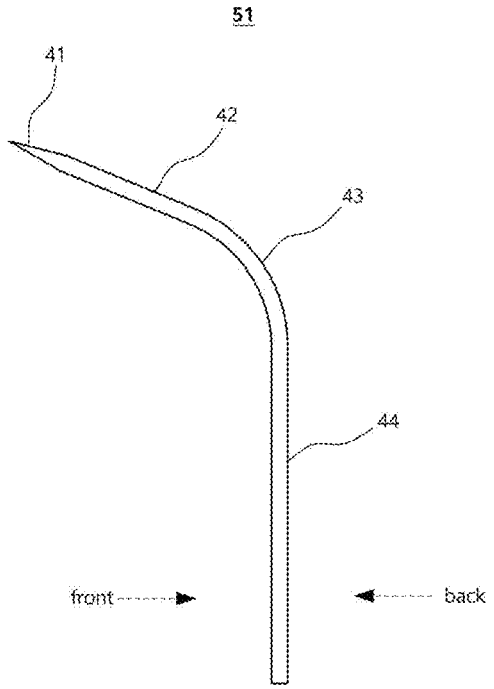
FIG. 2A is a cross-sectional view of an integral blade according to an embodiment of the present disclosure.
Figure 2B:
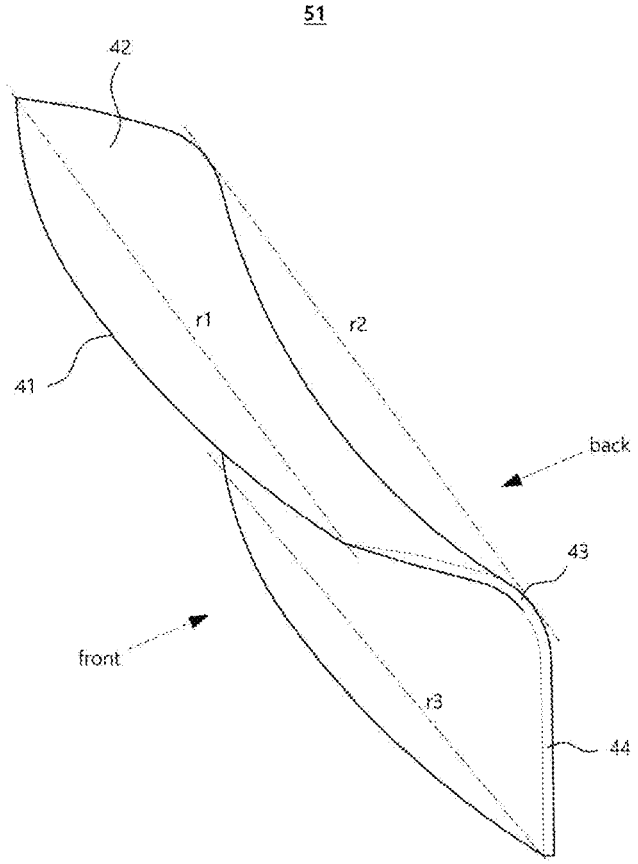
FIG. 2B is a perspective view of the integral blade illustrated in FIG. 2A.

FIG. 2A illustrates a cross-sectional view of an integral blade 51, and FIG. 2B illustrates a perspective view of the integral blade 51. Referring to FIG. 2A, the integral blade 51 may include a base portion 44 seated on the longitudinal end members 70*a* to 70*d* (see FIG. 4B), a cutting portion 42 including a cutting edge 41 at a front end side, and a bent portion 43 that is bent forward and configured to connect the base portion 44 and the cutting portion 42. Such an integral blade 51 may be manufactured using a single body by a bending process and may be designed such that a span between integral blades 51 is relatively narrow and the integral blade 51 has a relatively small thickness.

Such an integral blade 51 has to be designed to have sufficient stiffness while being thin and designed to have a geometrical shape that allows sufficient shaving performance and ease of washing to be secured while a plurality of integral blades 51 are mounted on a blade housing 60 of a limited size. As illustrated in FIG. 2B, the cutting edge 41, the bent portion 43, and the base portion 44 of the integral blade 51 may be manufactured to have an arch-like structure in which a middle portion further protrudes forward in comparison to other portions in width directions r1, r2, and r3. Particularly, as described above, the cutting edge 41 may be manufactured to have a form that protrudes forward (have a camber) when observed from the top and have a form that is bent downward (have a bow) when observed from the front. In this way, when the cutting edge 41 simultaneously has a camber and a bow, the integral blade 51 may have higher stiffness as compared with a blade that is bent in a straight shape.

Figure 2C:
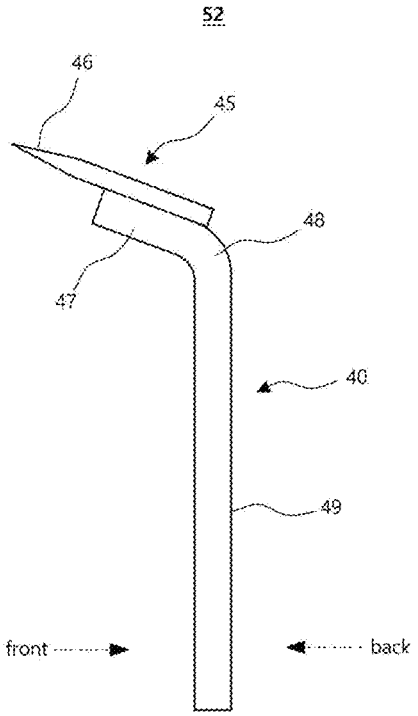
FIG. 2C is a cross-sectional view of a large steel blade according to an embodiment of the present disclosure.

However, in the present disclosure, the razor blade 5 is not necessarily the integral blade 51 and may also be a welded blade 52 that is manufactured by joining two members. As illustrated in FIG. 2C, the welded blade 52 is formed of two members including a metal support 40 that is formed to be relatively thick and seated on the longitudinal end members 70*a* to 70*d* (see FIG. 4B) and a cutting portion 45 that is bonded to the metal support 40 on the metal support 40 and includes a cutting edge 46. Like the integral blade 51, the metal support 40 includes a base portion 49 and a bent portion 48 and includes a blade attaching portion 47 configured to support and bond the cutting portion 45. Such a metal support 40 of the welded blade 52 may be formed to be thicker than the cutting portion 45 and may firmly support the cutting portion 45.

Generally, the razor blade 5 may be configured with the above-described integral blade 51 or the welded blade 52. However, embodiments are not limited thereto, and the razor blade 5 may be configured of any blade such as a straight blade or blades having various other forms as long as the blade has a shaving function.

Referring back to FIGS. 1A to 1D, in order to prevent detachment of the razor blade 5 from the blade housing 60, a pair of fixing clips 7*a* and 7*b* configured to fix both ends of the razor blade 5 to the blade housing 60 may be included. Generally, such fixing clips 7*a* and 7*b* are manufactured using metal materials such as aluminum, but embodiments are not limited thereto, and the fixing clips 7*a* and 7*b* may also be manufactured using various other materials such as a synthetic resin, synthetic fiber, and ceramic material.

According to an embodiment of the present disclosure, the blade housing 60 has, at a position in front of the at least one razor blade 5 accommodated in the blade housing 60, at least one side slit, preferably, a pair of side slits 80*a* and 80*b* which are open toward both side ends 64 and 63 of the blade housing 60.

Therefore, in order to fix both side ends of the razor blade 5, the pair of fixing clips 7*a* and 7*b* are configured to wrap around the rear portion 62 of the blade housing 60 and also accommodated in the side slits 80*a* and 80*b*.

Referring to the bottom view of the razor cartridge 10 illustrated in FIG. 1D, the blade housing 60 may include, at a lower surface 13, ribs 12*a* and 12*b* configured to support the blade housing 60 in a transverse direction that is perpendicular to a longitudinal direction of the razor blades. The ribs 12*a* and 12*b* are structures that reinforce the blade housing 60 in a direction orthogonal to the razor blade 5. The pair of ribs 12*a* and 12*b* may be disposed at left and right sides of the blade housing 60. However, embodiments are not limited thereto, and less or a greater number of ribs may also be disposed. The ribs 12*a* and 12*b* include guide surfaces 14*a* and 14*b* configured to guide a connector 20 to be easily engaged to the blade housing 60. The guide surfaces 14*a* and 14*b* are progressively inclined further in a depth direction of the ribs 12*a* and 12*b* so as to expand outwardly.

In addition, a hook coupling portion 15 that is configured to be engaged with an elastic hook 23 (see FIG. 13A) of the connector 20 is disposed at substantially a rear end of the razor blade 5. In addition, a central bar 17 that is pushed upon contact with a plunger of a razor handle 30 when the plunger protrudes is disposed at substantially a front end of the razor blade 5. In addition, the blade housing 60 may include, in addition to the ribs 12*a* and 12*b* or in place of the ribs 12*a* and 12*b*, one or more longitudinal end members 70*a* to 70*d* configured to connect and support the blade housing 60 in the transverse direction.

Figure 3A:
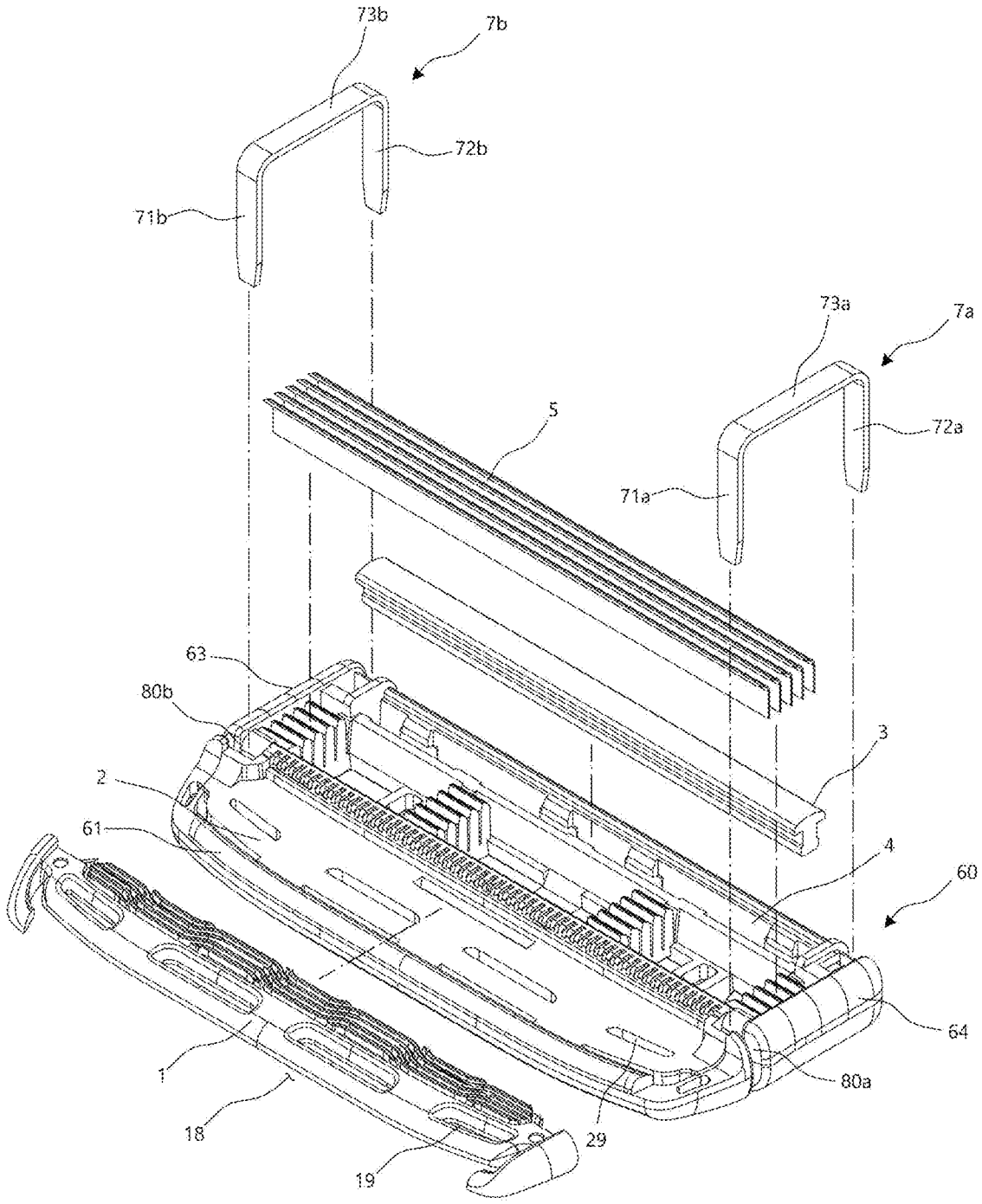
FIGS. 3A to 3C are exploded perspective views of the razor cartridge according to an embodiment of the present disclosure.
Figure 3B:
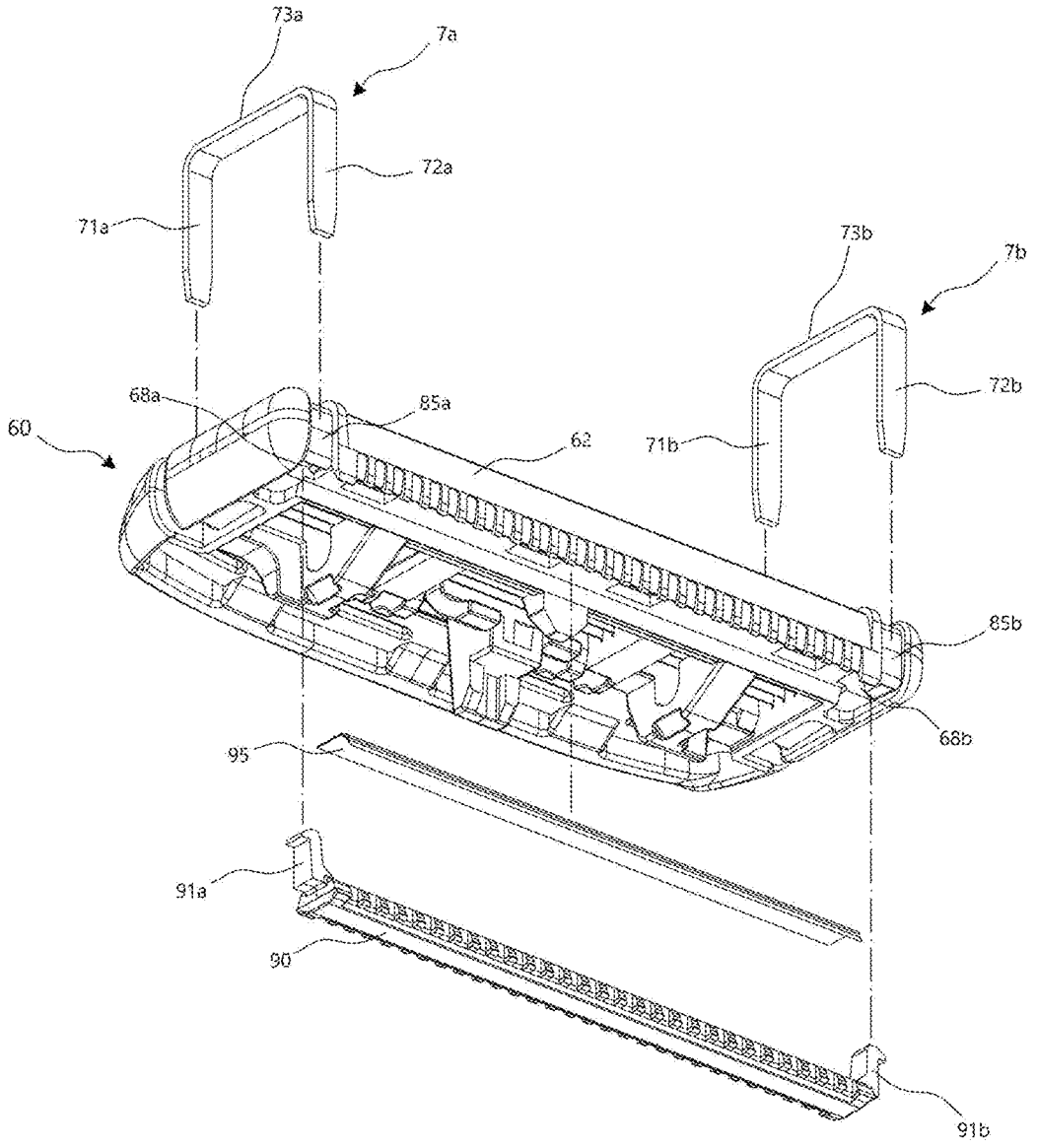

FIGS. 3A and 3B are exploded perspective views of the razor cartridge 10. Referring to FIG. 3A, the pair of fixing clips 7*a* and 7*b* respectively include first leg portions 71*a* and 71*b*, second leg portions 72*a* and 72*b*, and body portions 73*a* and 73*b* configured to connect the first and second leg portions. The first leg portions 71*a* and 71*b* are accommodated in a single side slit 80*a* or 80*b* of the pair of side slits 80*a* and 80*b*, and the second leg portions 72*a* and 72*b* are installed to surround the rear portion 62 of the blade housing 60. In this case, the both ends of the razor blade 5 are fixed in the blade housing 60 while being pressed toward a lower surface of the blade housing 60 due to the body portions 73*a* and 73*b* of the fixing clips 7*a* and 7*b*.

The side slits 80*a* and 80*b* are formed in the vicinity of the both side ends 64 and 63 of the blade housing 60 and are disposed in front of a position at which the razor blade 5 is mounted. Unlike a conventional through-hole structure, such side slits 80*a* and 80*b* are open toward the both side ends 64 and 63 of the blade housing 60. The first leg portions 71*a* and 71*b* may be accommodated in the side slits 80*a* and 80*b* and then bent at the lower surface of the blade housing 60 as illustrated in FIG. 1D.

Meanwhile, a pair of wrapping channels 85*a* and 85*b* may be formed at the rear portion 62 of the blade housing 60, and the second leg portions 72*a* and 72*b* may be bent at the lower surface of the blade housing 60 as illustrated in FIG. 1D while being accommodated in a single wrapping channel 85*a* or 85*b* of the pair of wrapping channels 85*a* and 85*b*. Since the wrapping channels 85*a* and 85*b* are formed to be more concave toward the front of the blade housing 60 as compared with the rear portion 62 of the blade housing 60, the wrapping channels 85*a* and 85*b* may more firmly seat the second leg portions 72*a* and 72*b*.

In addition, referring to FIG. 3A, the elastic member 1 is disposed on the guard bar 2 which is integrally formed with the blade housing 60 in the vicinity of the front portion 61 of the blade housing 60, and the cap member 3 is disposed in a cap accommodating portion 4 in the vicinity of the rear portion 62 of the blade housing 60. The elastic member 1 may be disposed by being adhered or structurally coupled to the guard bar 2. However, as illustrated in FIG. 3A, an opening 18 may be formed in front of the elastic member 1 so that the front portion 61 of the blade housing 60, instead of the elastic member 1, may be a portion that comes into contact with the user's skin first during shaving. In this way, by allowing the front portion 61, which is relatively firmer than the elastic member 1, to come into contact with the user's skin first, a front portion of the razor cartridge 10—on which the greatest force is exerted during shaving—does not shake. However, embodiments are not limited thereto, and the elastic member 1 may also be disposed to cover the front portion 61 of the blade housing 60. In this case, the elastic member 1 is a portion that comes into contact with the user's skin first during shaving, and an effect in which the elastic member 1 pulls the skin may be maximized rather than an effect in which the front portion of the razor cartridge 10 is prevented from shaking.

In addition, the elastic member 1 includes a plurality of through-holes 19, and the guard bar 2 also includes a plurality of through-holes 29 which are formed in positions corresponding to the through-holes 19. Such through-holes 19 and 29 facilitate discharge of a shaving aid or facial hair debris, which results from shaving, to the lower surface of the blade housing 60 during shaving or washing.

In addition to the above-described assembly of the elastic member 1, the razor blade 5, and the cap member 3, FIG. 3B shows a process in which a trimmer blade 95 and a trimmer cap 90 are assembled to the blade housing 60 at the lower surface of the blade housing 60. The trimmer cap 90 has fixing hooks 91*a* and 91*b* formed at both side ends, thereby having a structure in which the trimmer cap 90 is fixed as the fixing hooks 91*a* and 91*b* are inserted into through-holes 68*a* and 68*b* formed at positions corresponding to the blade housing 60. In this case, the trimmer blade 95 may be held and fixed between the trimmer cap 90 and the lower surface of the blade housing 60.

In this case, the second leg portions 72*a* and 72*b* fix the trimmer cap 90 to the blade housing 60 while surrounding a portion of the trimmer cap 90, specifically, the fixing hooks 91*a* and 91*b* of the trimmer cap 90 when the second leg portions 72*a* and 72*b* are bent at the lower surface of the blade housing 60 while surrounding the rear portion 62 of the blade housing 60. After the fixing hooks 91*a* and 91*b* formed at the both side ends of the trimmer cap 90 are coupled to the through-holes 68*a* and 68*b* of the blade housing 60 (see FIG. 4C), since the second leg portions 72*a* and 72*b* of the fixing clips 7*a* and 7*b* surround lower ends of the fixing hooks 91*a* and 91*b* of the trimmer cap 90 while being bent, the trimmer blade 95 and the trimmer cap 90 accommodating the same may be firmly fixed at the lower surface side of the blade housing 60 (see FIG. 1D).

Figure 3C:
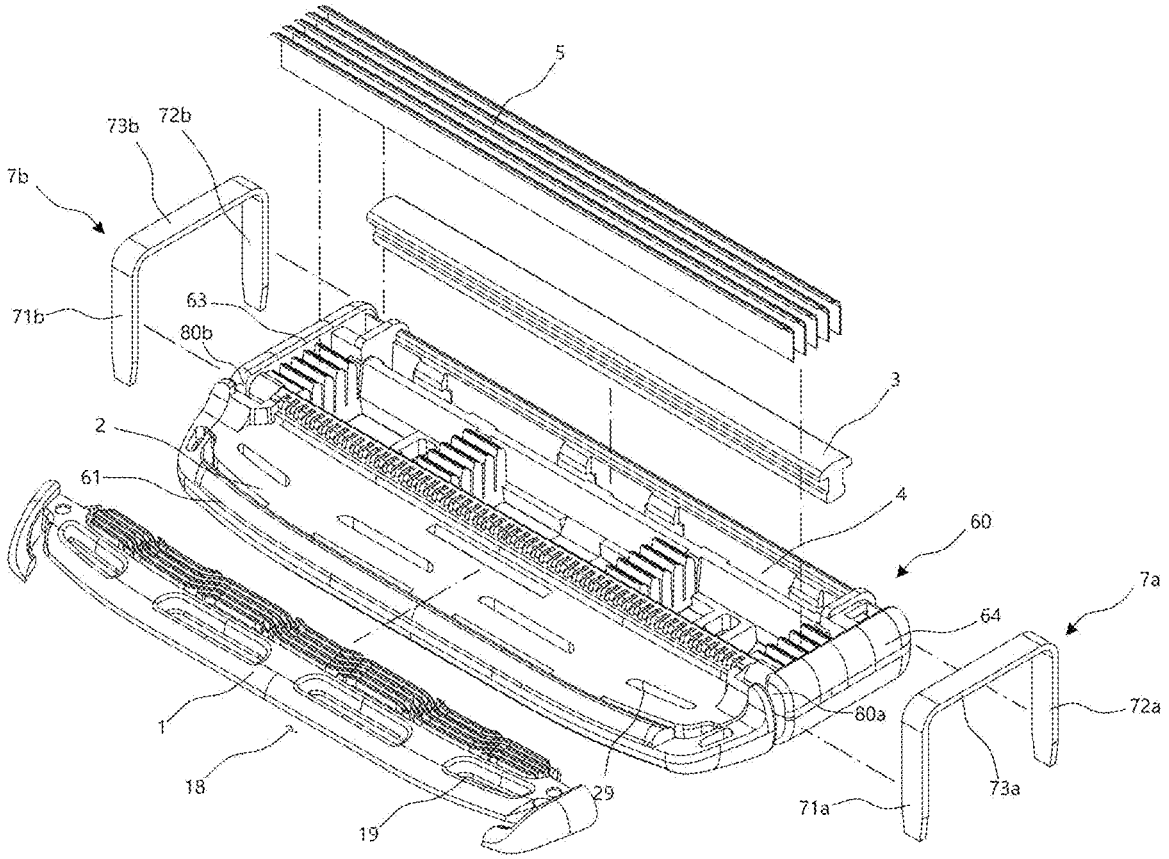

As illustrated in FIG. 3A, in the razor cartridge 10 according to an embodiment of the present disclosure, the fixing clips 7*a* and 7*b* may be assembled to the blade housing 60 in a downward direction. However, embodiments are not limited thereto, and as illustrated in FIG. 3C, the fixing clips 7*a* and 7*b* may also be assembled to the both side ends 64 and 63 of the blade housing 60 in a lateral direction. Such a degree of freedom of the assembly process is allowed by the structural characteristics of the side slits 80*a* and 80*b* according to an embodiment of the present disclosure. If the conventional through-hole structure is used instead of the side slits 80*a* and 80*b*, the fixing clips 7*a* and 7*b* may be assembled to the blade housing only in the downward direction. However, a portion between the two leg portions may have to be slightly expanded in order to fit the fixing clips 7*a* and 7*b* into accommodating channels 81*a* and 81*b* (see FIG. 4B) of the side slits 80*a* and 80*b* and the wrapping channels 85*a* and 85*b* during assembly of the fixing clips 7*a* and 7*b* in the transverse direction.

Various other advantages are obtained by using the side slits 80*a* and 80*b* instead of through-holes. Problems in that a degree of precision of an injection process has to be increased or complexity of a mold structure is increased in order to form a fine through-hole in the blade housing as in a conventional case may be solved. Further, the possibility that an injection failure would occur at both closed side ends of a blade housing in which through-holes are formed as in a conventional case may also decreased.

Figure 4A:
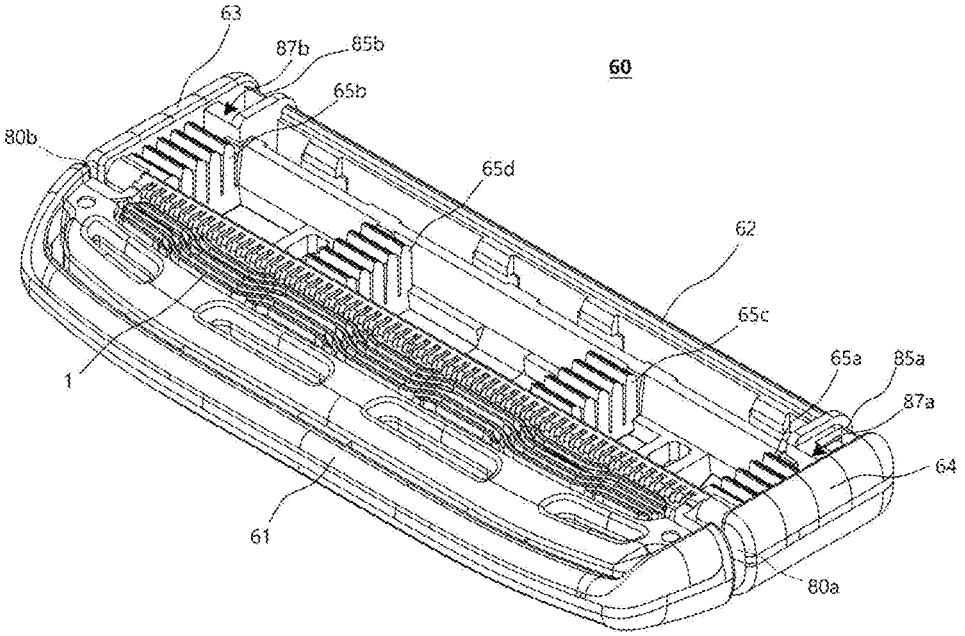
FIG. 4A is a perspective view of a blade housing in a state in which razor blades, a cap member, and a fixing clip are removed from the razor cartridge illustrated in FIG. 1A.
Figure 4B:
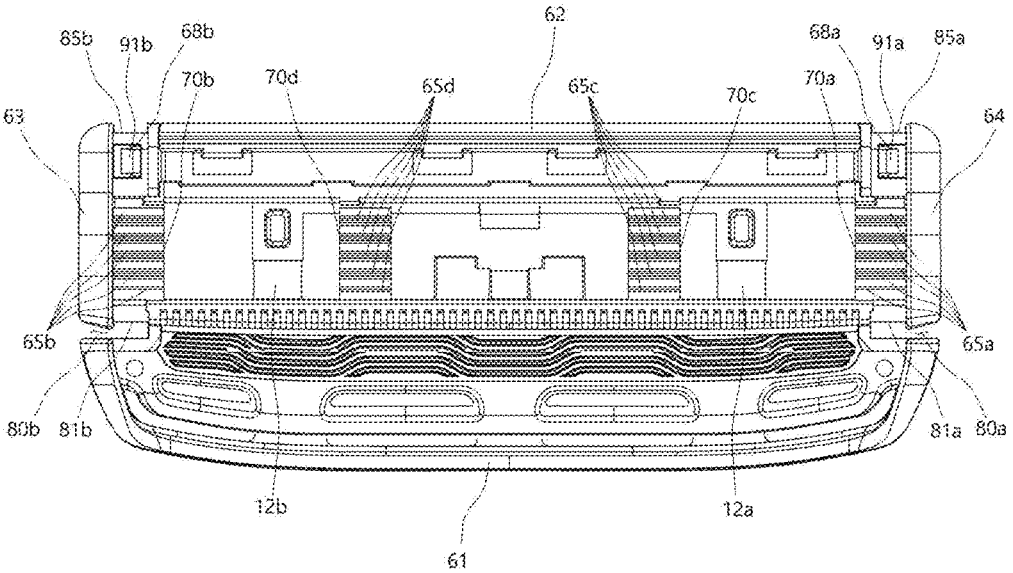
FIG. 4B is a plan view of the blade housing illustrated in FIG. 4A.
Figure 4C:
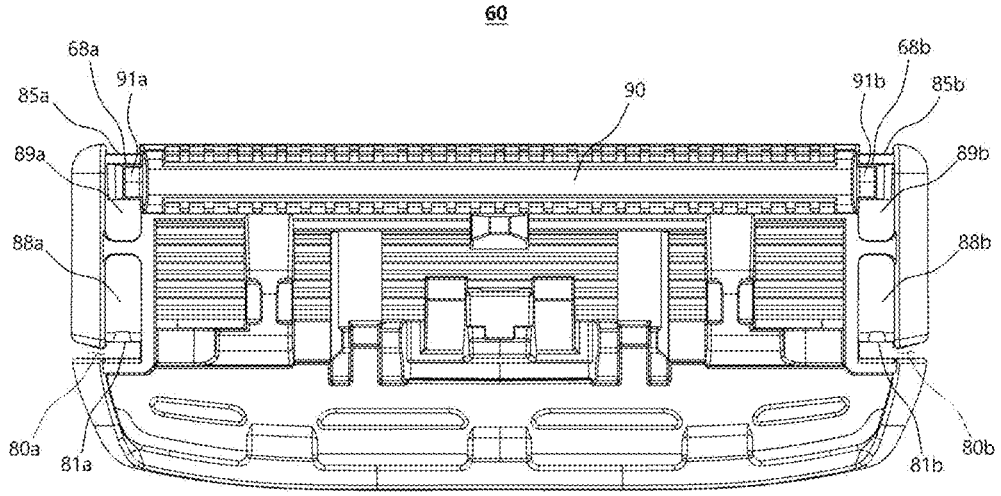
FIG. 4C is a bottom view of the blade housing illustrated in FIG. 4A.

FIGS. 4A to 4C are, respectively, a perspective view, a plan view, and a bottom view, of the blade housing 60 in which the razor blade 5, the cap member 3, and the fixing clips 7*a* and 7*b* are removed from the razor cartridge 10. Here, the elastic member 1 may be integrally injected (doubly injected) with the blade housing 60, or may be a separate object from the blade housing 60 and attached or coupled to the blade housing 60. When the elastic member 1 is formed as a separate object from the blade housing 60 as described above, the blade housing 60 may be understood as a portion excluding the elastic member 1 in FIG. 4A.

As illustrated in FIGS. 4A to 4C, some embodiments of the blade housing 60 may be fundamentally understood as a quadrilateral frame structure including a front portion 61, a rear portion 62 formed opposite the front portion 61, and a left side end 63 and a right side end 64 configured to connect the front portion 61 and the rear portion 62. In addition, the blade housing 60 includes one or more longitudinal end members 70*a* to 70*d* configured to connect and support the blade housing 60 in a direction perpendicular to the direction in which the razor blade 5 is disposed. In one embodiment, the longitudinal end members 70*a* to 70*d* connect the front portion 61 and the rear portion 62 of the blade housing 60 in the longitudinal direction.

A case in which four longitudinal end members 70*a* to 70*d* are used is illustrated in FIG. 4B, but embodiments are not limited thereto. The number of longitudinal end members may be any number that is 1 or greater and that is suitable for stably supporting the razor blade 5.

A plurality of seating protrusions 65*a* to 65*d* for seating the at least one razor blade 5 are aligned on the longitudinal end members 70*a* to 70*d*. In addition to the longitudinal end members 70*a* to 70*d*, one or more ribs 12*a* and 12*b* configured to reinforce the blade housing 60 may be further included. However, embodiments are not limited thereto, and the ribs 12*a* and 12*b* may be omitted or be integrally formed with the longitudinal end members 70*a* to 70*d*.

A case in which the plurality of seating protrusions 65*a* to 65*d* have the same shape and size is illustrated in FIG. 4A, but embodiments are not limited thereto. The shapes, sizes, and arrangement positions of the plurality of seating protrusions 65*a* to 65*d* may also differ from each other. For example, high seating protrusions and low seating protrusions may be alternately disposed, or the same seating protrusions may be disposed at different sides, instead of the same side (e.g., zigzag arrangement).

Particularly, since the fixing clips 7*a* and 7*b* are mounted at positions of the longitudinal end members 70*a* and 70*b*, which are disposed in the vicinity of the right side end 64 and the left side end 63 of the blade housing 60, both ends of the razor blade 5 may be more firmly seated between the longitudinal end members 70*a* and 70*b* and the fixing clips 7*a* and 7*b*.

The side slits 80*a* and 80*b* and the wrapping channels 85*a* and 85*b* may be disposed in front of and behind longitudinal end members 70*a* and 70*b*. Here, the pair of side slits 80*a* and 80*b* respectively include the accommodating channels 81*a* and 81*b* which are formed to be more concave toward the rear of the blade housing 60 than positions at which the side slits 80*a* and 80*b* are open toward the both side ends 64 and 63 of the blade housing 60. Therefore, since the first leg portions 71*a* and 71*b* of the fixing clips 7*a* and 7*b* may be bent at the lower surface 13 of the blade housing 60 while surrounding the accommodating channels 81*a* and 81*b*, the fixing clips 7*a* and 7*b* may be prevented from being detached or becoming dislodged toward an outer direction in which the slide slits 80*a* and 80*b* are open. Likewise, since the second leg portions 72*a* and 72*b* of the fixing clips 7*a* and 7*b* may be bent while surrounding the wrapping channels 85*a* and 85*b* formed at the rear portion 62 of the blade housing 60, the fixing clips 7*a* and 7*b* may be prevented from being detached or becoming dislodged toward an inner direction or outer direction of the blade housing 60.

Meanwhile, on at least one surface of an upper surface 11 and the lower surface 13 of the blade housing 60, guide recesses which extend between the pair of side slits 80*a* and 80*b* and the pair of wrapping channels 85*a* and 85*b* may be formed in order to guide seating of the pair of fixing clips 7*a* and 7*b*. As illustrated in FIG. 4A, at the upper surface of the blade housing 60, guide recesses 87*a* and 87*b* which are more concave downward than other portions of the blade housing while connecting the side slits 80*a* and 80*b* and the wrapping channels 85*a* and 85*b* may be formed between the side slits 80*a* and 80*b* and the wrapping channels 85*a* and 85*b*. Such guide recesses 87*a* and 87*b* have shapes that correspond to the body portions 73*a* and 73*b* of the fixing clips 7*a* and 7*b* and allow the body portions 73*a* and 73*b* to be firmly seated on the upper surface of the blade housing 60 without becoming dislodged.

Likewise, as illustrated in FIG. 4C, at the lower surface of the blade housing 60, guide recesses 88*a*, 88*b*, 89*a*, and 89*b* which are more concave upward than other portions of the blade housing while connecting the side slits 80*a* and 80*b* and the wrapping channels 85*a* and 85*b* may be formed between the side slits 80*a* and 80*b* and the wrapping channels 85*a* and 85*b*. Such guide recesses 88*a*, 88*b*, 89*a*, and 89*b* have shapes that allow the first leg portions 71*a* and 71*b* and the second leg portions 72*a* and 72*b* of the fixing clips 7*a* and 7*b* to be accommodated therein, and the guide recesses 88*a*, 88*b*, 89*a*, and 89*b* allow for some degree of assembly error during assembly of the fixing clips 7*a* and 7*b*. In addition, the guide recesses 88*a*, 88*b*, 89*a*, and 89*b* allow the first leg portions 71*a* and 71*b* and the second leg portions 72*a* and 72*b* to be firmly seated without becoming dislodged on the lower surface of the blade housing 60 when the first leg portions 71*a* and 71*b* and the second leg portions 72*a* and 72*b* are being bent.

Figure 5A:
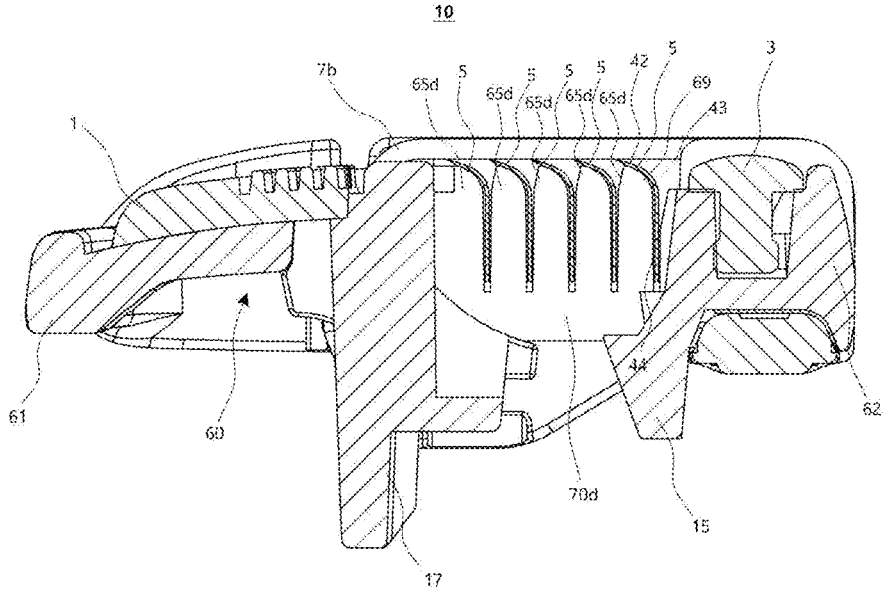
FIG. 5A is a cross-sectional view of the razor cartridge of FIG. 1B taken along line A-A' in FIG. 1B.

FIG. 5A is a cross-sectional view of the razor cartridge 10 of FIG. 1B taken along line A-A' in FIG. 1B. Referring to FIG. 5A, five razor blades 5 are inserted into gaps (seating slots) between seating protrusions 65*d* which are disposed in a row at the longitudinal end member 70*d*. Here, it can be seen that at least a portion of a front surface of each of the five razor blades 5 is supported by a round portion 69 of a corresponding first seating protrusion 65*d*. Here, each of the razor blades 5 is illustrated as the integral blade 51 which is illustrated in FIG. 2A.

Specifically, when each of the razor blades 5 includes the cutting portion 42, the bent portion 43, and the base portion 44, portions of the cutting portion 42 and the bent portion 43 in the front surfaces of the razor blades 5 may be supported by the round portion 69 of the corresponding first seating protrusion 65*d*. In addition, the base portion 44 may be inserted into the gap between the seating protrusions 65*d* and be supported between the seating protrusions 65*d*. In reality, according to various embodiments in which the razor blades 5 are seated in the longitudinal end members 70*a* to 70*d*, arbitrary points excluding the cutting edges of the razor blades 5 may be supported by the seating protrusions 65*a* to 65*d*.

Figure 5B:
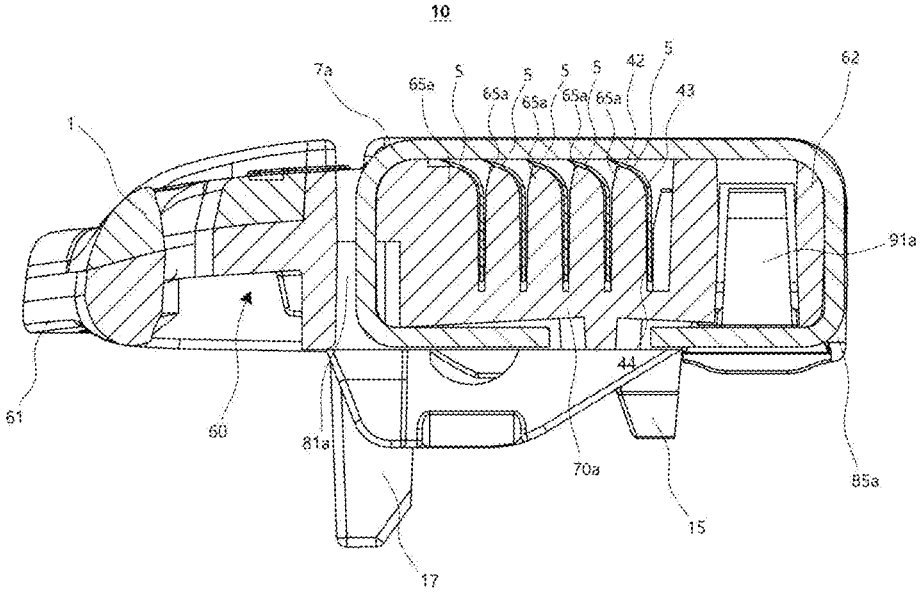
FIG. 5B is a cross-sectional view of the razor cartridge of FIG. 1B taken along line B-B' in FIG. 1B.

FIG. 5B is a cross-sectional view of the razor cartridge 10 of FIG. 1B taken along line B-B' in FIG. 1B. Referring to FIG. 5B, five razor blades 5 are inserted into seating slots between seating protrusions 65*a* which are disposed in a row at the longitudinal end member 70*a*. In this case, as the cutting portion 42 of the razor blade 5 is pressed by the fixing clip 7*a*, the entire razor blade 5 is firmly seated in the seating slot. As illustrated, the fixing clip 7*a* is bent at the lower surface of the blade housing 60 while surrounding both the accommodating channel 81*a* in the side slit 80*a* and the wrapping channel 85*a* of the rear portion 62. In FIGS. 5A and 5B, an example in which the razor blade 5 is implemented as the integral blade 51 is illustrated. However, embodiments are not limited thereto, and the razor blade 5 may also be implemented as the large steel blade 52 which is formed of two members.

As illustrated in FIG. 5B, the two leg portions 71*a* and 72*a* of the fixing clip 7*a* may be bent at the lower surface of the blade housing 60 and, particularly, be accommodated in the guide recesses 88*a* and 89*a* formed in the lower surface of the blade housing 60. However, in FIG. 5B, the two leg portions 71*a* and 72*a* are illustrated as not being adhered to the guide recesses 88*a* and 89*a* while forming an acute angle and illustrated as being somewhat spaced apart from surfaces of the guide recesses 88*a* and 89*a* while forming about a 90° angle. This is because, even when the leg portions 71*a* and 72*a* of the fixing clip 7*a* are bent corresponding to profiles of the guide recesses 88*a* and 89*a* of the lower surface of the blade housing 60, the leg portions 71*a* and 72*a* may be somewhat spaced apart from the guide recesses 88*a* and 89*a* due to the basic elasticity of the fixing clip 7*a*.

However, embodiments are not limited thereto, and the two leg portions 71*a* and 72*a* of the fixing clip 7*a* may be bent to form an acute angle corresponding to the profiles of the guide recesses 88*a* and 89*a* or may also be bent to form an obtuse angle while being further spaced apart from the profiles. However, an engaging force of the fixing clip 7*a* will be increased as the acute angle formed by the leg portions 71*a* and 72*a* becomes smaller and will be decreased as the obtuse angle formed by the leg portions 71*a* and 72*b* becomes larger.

In addition, although the guide recesses 88*a* and 89*a* are illustrated in FIG. 5B as forming an acute angle with respect to a front corner and a rear corner of the lower surface of the blade housing 60, embodiments are not limited thereto. The guide recesses 88*a* and 89*a* may also form a 90° angle or an obtuse angle. In this way, when the guide recesses 88*a* and 89*a* form an angle that is 90° or greater at the lower surface of the blade housing 60, particularly, it may be preferable, in terms of increasing the engaging force of the fixing clip 7*a*, that the leg portions 71*a* and 72*a* of the fixing clip 7*a* be bent to resemble the profiles of the guide recesses 88*a* and 89*a*.

Figure 5C:
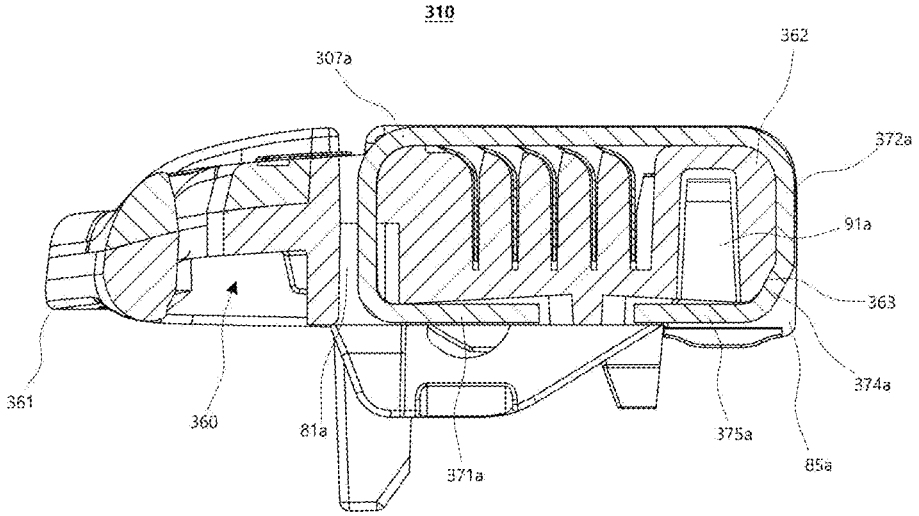
FIG. 5C is a cross-sectional view of the razor cartridge according to another embodiment in which the shape of the rear portion of the blade housing and the shape of the fixing clip in the razor cartridge.

Meanwhile, FIG. 5C shows a razor cartridge 310 according to another embodiment in which the shape of the rear portion 62 of the blade housing 60 and the shape of the fixing clip 7*a* in the razor cartridge 10 of FIG. 5B are deformed. In FIG. 5C, an angled surface 363 is formed at a lower side of at least one of a front portion 361 and a rear portion 362 of a blade housing 360. In addition, accordingly, at least one of a first leg portion 371*a* and a second leg portion 372*a* of a fixing clip 307*a* has a double bend configuration. For example, when the second leg portion 372*a* has the double bend configuration, the second leg portion 372*a* is first bent about 90° downward from the rear portion 362 of the blade housing 360, and then a middle portion 374*a* of the second leg portion 372*a* is secondly bent along the angled surface 363. Then, ultimately, an end 375*a* of the second leg portion 372*a* is bent along a lower surface of the blade housing 360. In this way, since at least one of the two leg portions 371*a* and 372*a* of the fixing clip 307*a* is seated on the blade housing 360 while having the double bend configuration, a greater engaging force may be guaranteed as compared with a single bend configuration.

Figure 6:
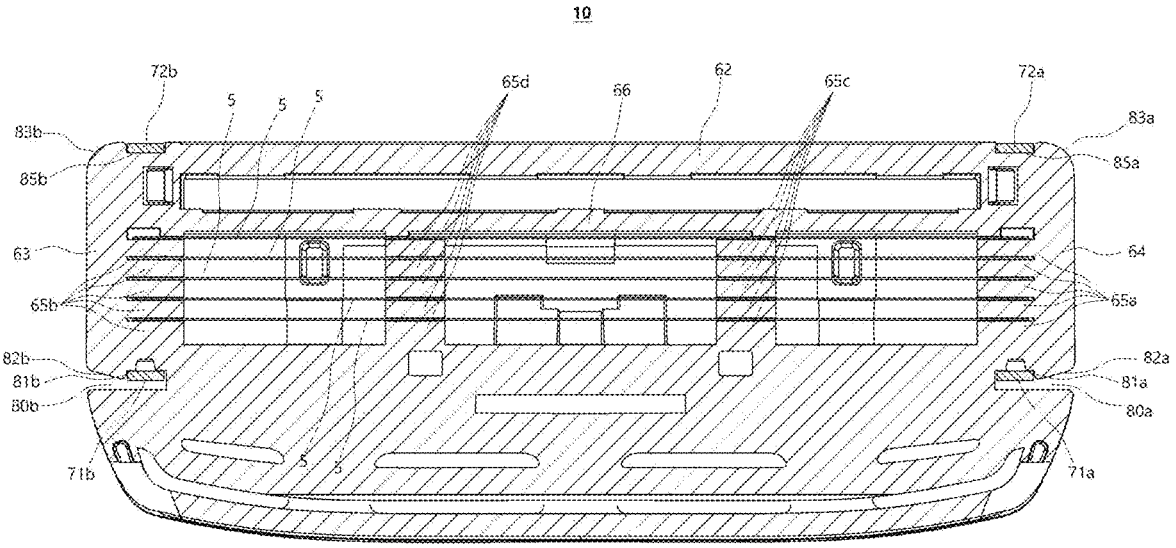
FIG. 6 is a cross-sectional view of the razor cartridge of FIG. 1C taken along line C-C' in FIG. 1C.

FIG. 6 is a cross-sectional view of the razor cartridge 10 of FIG. 1C taken along line C-C' in FIG. 1C. As described above, the razor blade 5 may be stably supported between the seating protrusions 65*a* to 65*d*. However, a rear surface of the last razor blade 5 may be caused to be directly supported by a rear wall 66 of the blade housing 60 instead of the seating protrusions 65*a* to 65*d*. This is because, rather than causing the seating protrusions 65*a* to 65*d* to be disposed up to the rear position of the last razor blade 5, by causing the rear surface of the last razor blade 5 to be directly supported by the rear wall 66 or protrusions which slightly protrude forward from the rear wall 66, the structure of the blade housing 60 may be further simplified.

Referring to FIG. 6, the first leg portions 71*a* and 71*b* of the pair of fixing clips 7*a* and 7*b* are respectively accommodated in the accommodating channels 81*a* and 81*b* of the side slits 80*a* and 80*b*, and the second leg portions 72*a* and 72*b* are respectively accommodated in the wrapping channels 85*a* and 85*b* formed at the rear portion 62. In addition, angled surfaces 82*a* and 83*a* or 82*b* and 83*b*, which are tapered, are formed toward outer sides of the both side ends of the blade housing 60 from the accommodating channels 81*a* and 81*b* and the wrapping channels 85*a* and 85*b*. Therefore, when the fixing clips 7*a* and 7*b* are inserted, a portion between the two leg portions 71*a* and 72*a* or 71*b* and 72*b* is widened such that seating of the fixing clips 7*a* and 7*b* on the accommodating channels 81*a* and 81*b* or the wrapping channels 85*a* and 85*b* is facilitated.

FIGS. 7A to 7D are views illustrating a razor cartridge 110 according to a second embodiment of the present disclosure. Here, elements of the razor cartridge 110 are the same as those in the above-described first embodiment except for the shape of the guard bar 2, shown in FIGS. 7A to 7D as guard bar 102. In the above-described first embodiment, the guard bar 2 is formed at a front portion of the razor blade 5, and both side ends of the guard bar 2 further extend in the longitudinal direction past the positions of the pair of fixing clips 7*a* and 7*b*. In addition, the elastic member 1 having substantially the same transverse size as the guard bar 2 is disposed at an upper side of the guard bar 2. Therefore, according to the first embodiment, the guard bar 2 and the elastic member 1 may have corresponding (substantially the same) sizes.

In contrast, in the razor cartridge 110 according to the second embodiment illustrated in FIGS. 7A to 7D, although a guard bar 102 is formed at a front portion 161 of a blade housing 160 similarly, the size of both side ends 6*a* and 6*b* of the guard bar 102 are limited such that both side ends 6*a* and 6*b* are disposed between the pair of fixing clips 7*a* and 7*b* and do not overlap the pair of fixing clips 7*a* and 7*b*. In addition, an elastic member 1 is disposed at an upper side of the guard bar 2, and both side ends 8*a* and 8*b* of the elastic member 1 further extend in the transverse direction past the positions of the pair of fixing clips 7*a* and 7*b*. In this way, by limiting the length of the guard bar 102 to be within the range between the fixing clips 7*a* and 7*b*, assembly is further facilitated when assembling the fixing clips 7*a* and 7*b* to the blade housing 160. Furthermore, since the both side ends 8*a* and 8*b* of the elastic member 1 extend past the both side ends 6*a* and 6*b* of the guard bar 102, flexibility is assigned to both corner sides of the front portion 161 of the blade housing 160 during shaving, and closeness to skin and convenience of shaving may be improved.

Figure 8A:
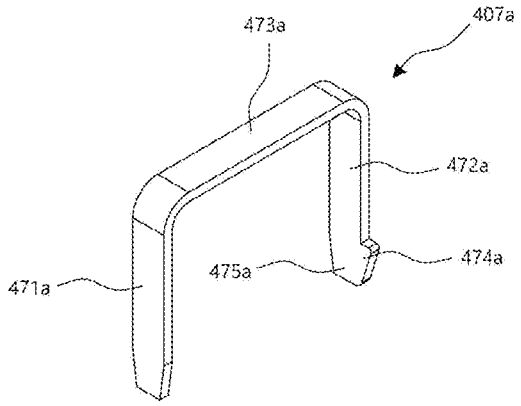
FIGS. 8A and 8B are, respectively, a perspective view of a fixing clip according to another embodiment of the present disclosure and a bottom view of a razor cartridge having the fixing clip mounted thereon.
Figure 8B:
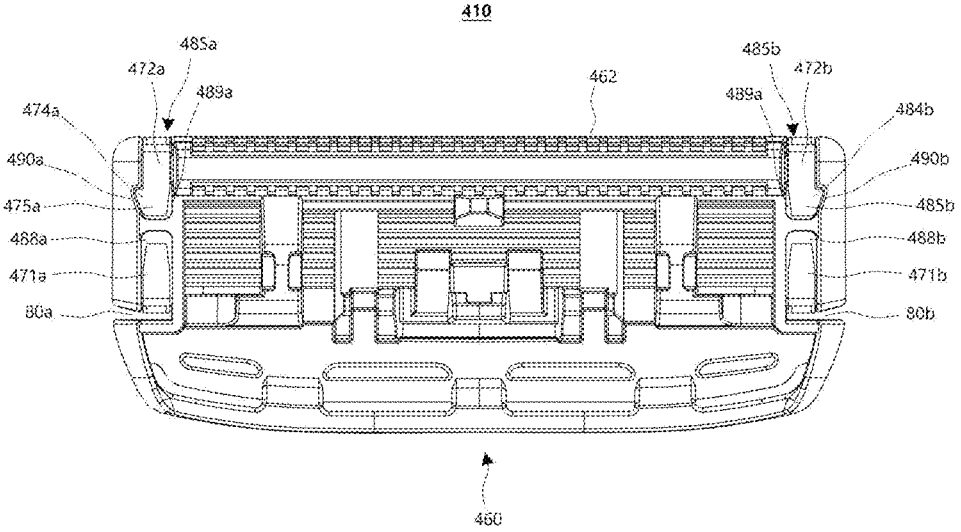

FIGS. 8A and 8B are, respectively, a perspective view of a fixing clip 407*a* according to another embodiment of the present disclosure and a bottom view of a razor cartridge 410 having the fixing clip 407*a* mounted thereon. Referring to FIGS. 8A and 8B, each fixing clip 407*a* includes a first leg portion 471*a*, a second leg portion 472*a*, and a body portion 473*a* configured to connect the first and second leg portions 471*a* and 472*a*. Here, on at least one end 475*a* of the first and second leg portions 471*a* and 472*a*, a hook 474*a* is formed in an outer direction of a blade housing 460. It will be understood that a fixing clip 407*b* which has a shape that is symmetrical to that of the fixing clip 407*a* may be mounted at an opposite side of a position at which the fixing clip 407*a* is mounted.

Referring to FIG. 8B, first leg portions 471*a* and 471*b* of the pair of fixing clips 407*a* and 407*b* are accommodated in a single side slit 80*a* or 80*b* of the pair of side slits 80*a* and 80*b*, and second leg portions 472*a* and 472*b* are installed to surround a rear portion 462 of the blade housing 460. In this case, the first leg portions 471*a* and 471*b* are accommodated in the side slits 80*a* and 80*b* and then bent at a lower surface of the blade housing 460, and the second leg portions 472*a* and 472*b* are bent at the lower surface of the blade housing 460 while being accommodated in wrapping channels 485*a* and 485*b* formed at the rear portion 462. In this way, when the second leg portions 472*a* and 472*b* are seated while being accommodated in guide recesses 489*a* and 489*b*, hooks 474*a* and 474*b* formed in the outer direction of the blade housing 460 at ends 475*a* and 475*b* of the second leg portions 472*a* and 472*b* are aligned with notches 490*a* and 490*b* of the corresponding guide recesses 489*a* and 489*b*. Such alignment between the hooks 474*a* and 474*b* and the notches 490*a* and 490*b* prevents detachment of the second leg portions 472*a* and 472*b* toward the rear of the blade housing 460 and further improves engaging forces of the fixing clips 407*a* and 407*b*.

In FIGS. 8A and 8B, the hooks 474*a* and 474*b* and the notches 490*a* and 490*b* are illustrated as being aligned only at the second leg portions 472*a* and 472*b* of the fixing clips

407*a* and 407*b* and the guide recesses 489*a* and 489*b* corresponding thereto, but embodiments are not limited thereto. Such hook-notch alignment may also be applied to the first leg portions 471*a* and 471*b* or all of the first leg portions 471*a* and 471*b* and the second leg portions 472*a* and 472*b*, or on multiple points along the first leg portions, the second leg portions, and/or the body portions.

Figure 8C:
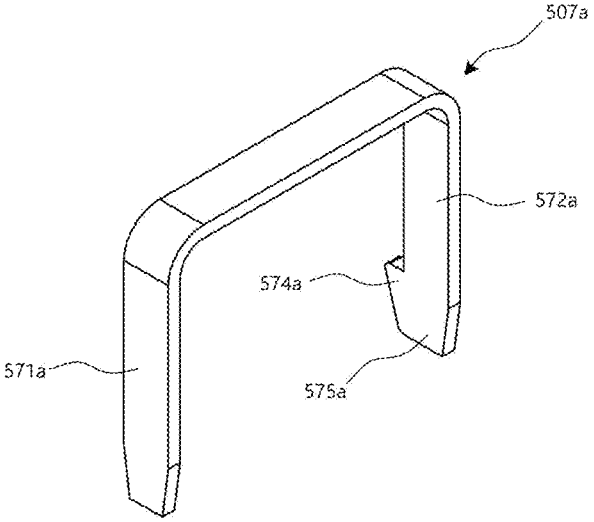
FIGS. 8C and 8D are, respectively, a perspective view of a fixing clip according to still another embodiment of the present disclosure and a bottom view of a razor cartridge having the fixing clip mounted thereon.
Figure 8D:
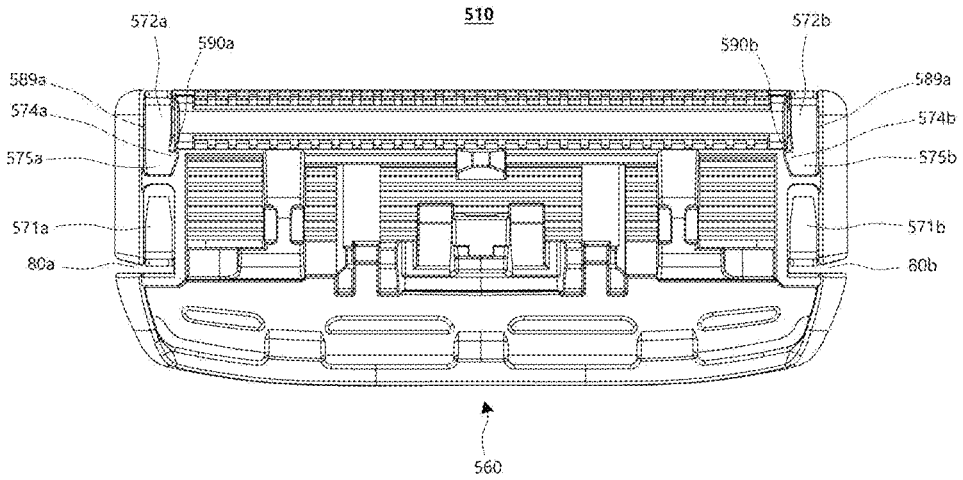

Meanwhile, FIGS. 8C and 8D are, respectively, a perspective view of a fixing clip 507*a* according to another embodiment of the present disclosure and a bottom view of a razor cartridge 501 having the fixing clip 507*a* mounted thereon. In FIG. 8C, on at least one end 575*a* of first and second leg portions 571*a* and 572*a* of the fixing clip 507*a*, a hook 574*a* is formed in an inner direction of a blade housing 560. It will be understood that, as illustrated in FIG. 8D, a fixing clip 507*b* which has a shape that is symmetrical to that of the fixing clip 507*a* may be further mounted at an opposite side of a position at which the fixing clip 507*a* is mounted.

Referring to FIG. 8D, when second leg portions 572*a* and 572*b* are seated while being accommodated in guide recesses 589*a* and 589*b*, hooks 574*a* and 574*b* formed in the inner direction of the blade housing 560 at ends 575*a* and 575*b* of the second leg portions 572*a* and 572*b* are aligned with notches 590*a* and 590*b* of the corresponding guide recesses 589*a* and 589*b*. Such alignment between the hooks 574*a* and 574*b* and the notches 590*a* and 590*b* prevents detachment of the second leg portions 572*a* and 572*b* toward the rear of the blade housing 560 and further improves engaging forces of the fixing clips 507*a* and 507*b*. Instead of being applied only to the second leg portions 572*a* and 572*b*, such hook-notch alignment may also be applied to the first leg portions 571*a* and 571*b* or all of the first leg portions 571*a* and 571*b* and the second leg portions 572*a* and 572*b*, or on multiple points along the first leg portions, the second leg portions, and/or the body portions.

In the embodiments illustrated in FIGS. 8A to 8D, the hooks disposed at the first leg portions or the second leg portions have been described as being formed to protrude in any one direction of the inner direction and the outer direction of the blade housing. However, embodiments are not limited thereto, and the fixing clips may also be configured such that the hooks are formed to protrude in both the inner and outer directions of the blade housing. In addition, in reality, since detachment of the leg portions of the fixing clips toward the front or rear may be sufficiently prevented by just using one-way hooks, there is no significant problem even in terms of engaging forces of the fixing clips.

In addition, in the embodiments illustrated in FIGS. 8A to 8D, it has been described that hooks are formed in the outer direction or inner direction of the blade housing at the ends of the leg portions of the fixing clips, and such hooks are aligned with the notches disposed in the guide recesses which are formed at the lower surface of the blade housing. However, after the leg portions of the fixing clips are bent at the lower surface of the blade housing, another configuration may also be used to prevent detachment of the leg portions toward the front portion or rear portion of the blade housing. For example, unlike the above-described structure, at least one notch may be formed at ends of the leg portions of the fixing clips, and the notch may be caused to be coupled to a protrusion formed in a corresponding area of a guide recess. Even in this case, the same advantageous effect, which is achieved by the above-described embodiments, may be achieved since the bent leg portions of the fixing clips are not detached from the guide recesses toward the front portion or rear portion of the blade housing.

FIGS. 9A to 9D are views illustrating a razor cartridge 210 according to a third embodiment of the present disclosure. In comparison to the first embodiment, two side slits 280*a* and 285*a* or 280*b* and 285*b* are formed in front of and behind a razor blade 5 in a blade housing 260 of the razor cartridge 210 according to the third embodiment. Therefore, the wrapping channels 85*a* and 85*b* in the first embodiment are replaced with rear side slits 285*a* and 285*b*. Since other configurations are the same as those in the first embodiment, description will be given below with focus on differences from the first embodiment.

The razor cartridge 210 according to the third embodiment includes a razor blade 5 having a cutting edge 41, the blade housing 260 configured to accommodate the razor blade 5 in a longitudinal direction which is perpendicular to a shaving direction d1, and a pair of fixing clips 7*a* and 7*b* configured to fix both ends of the razor blade 5 in order to seat the razor blade 5 in the blade housing 260. In this case, at both side ends 263 and 264 of the blade housing 260, front side slits 280*a* and 280*b* which are open toward the both side ends 263 and 264 of the blade housing 260 in front of each accommodated razor blade 5 and rear side slits 285*a* and 285*b* which are open toward the both side ends 263 and 264 of the blade housing 260 behind the razor blade 5 are formed. In order to form the rear side slits 285*a*and 285*b*, the blade housing 260 further includes shoulder portions 286*a* and 286*b* which extend in both outer directions from a rear portion 262 of the blade housing 260.

Each of the pair of fixing clips 7*a* and 7*b* includes first leg portions 71*a* and 71*b* and second leg portions 72*a* and 72*b*. The first leg portions 71*a* and 71*b* are bent at a lower surface of the blade housing 260 while passing through the front side slits 280*a* and 280*b* toward the bottom of the blade housing 260, and the second leg portions 72*a* and 72*b* are bent at the lower surface of the blade housing 260 while passing through the rear side slits 285*a* and 285*b* toward the bottom of the blade housing 260.

Figure 10A:
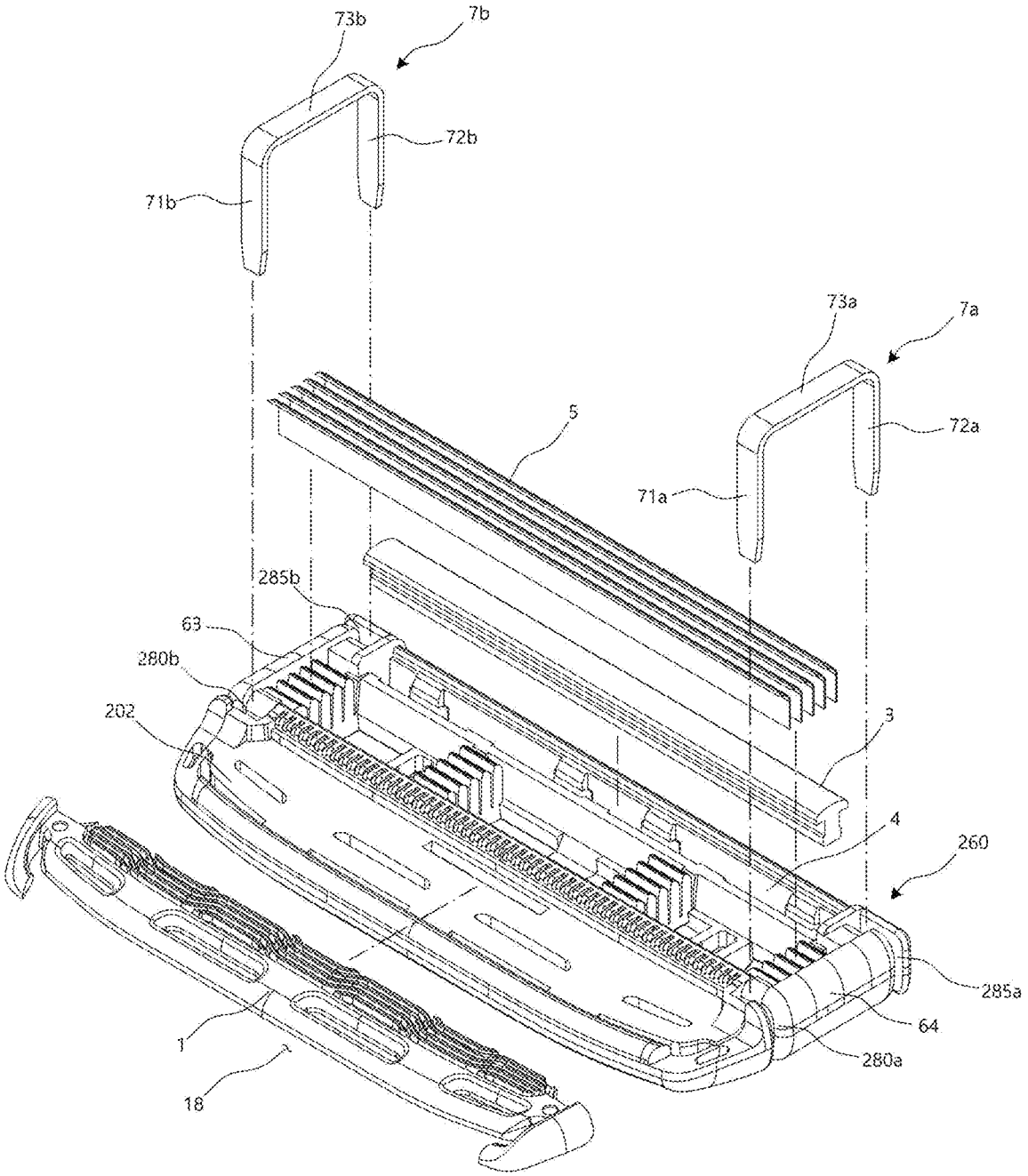
FIGS. 10A and 10B are assembly views of the razor cartridge according to the third embodiment of the present disclosure.
Figure 10B:
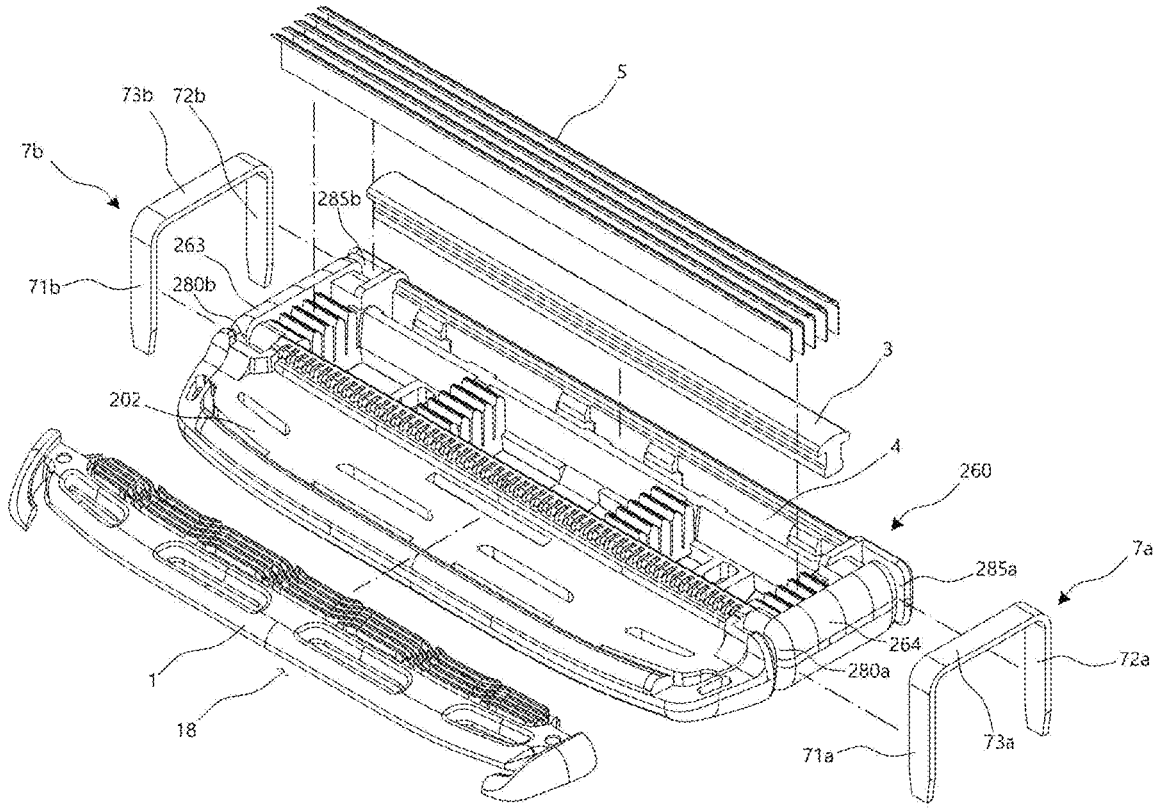

FIGS. 10A and 10B are assembly views of the razor cartridge 210 according to the third embodiment. Referring to FIG. 10A, in the razor cartridge 210 according to the third embodiment, the fixing clips 7*a* and 7*b* may be assembled to the blade housing 260 in a downward direction. Furthermore, as illustrated in FIG. 10B, the fixing clips 7*a* and 7*b* may also be assembled in a lateral direction (a direction in which razor blades 5 are arranged) at the both side ends 263 and 264 of the blade housing. In this way, since both the two leg portions 71*a* and 72*a* or 71*b* and 72*b* of the fixing clips 7*a* and 7*b* may be fitted into the side slits 280*a* and 285*a* or 280*b* and 285*b* from the side, the degree of freedom of an assembly process of the razor cartridge 210 according to the third embodiment may be further improved.

Figure 10C:
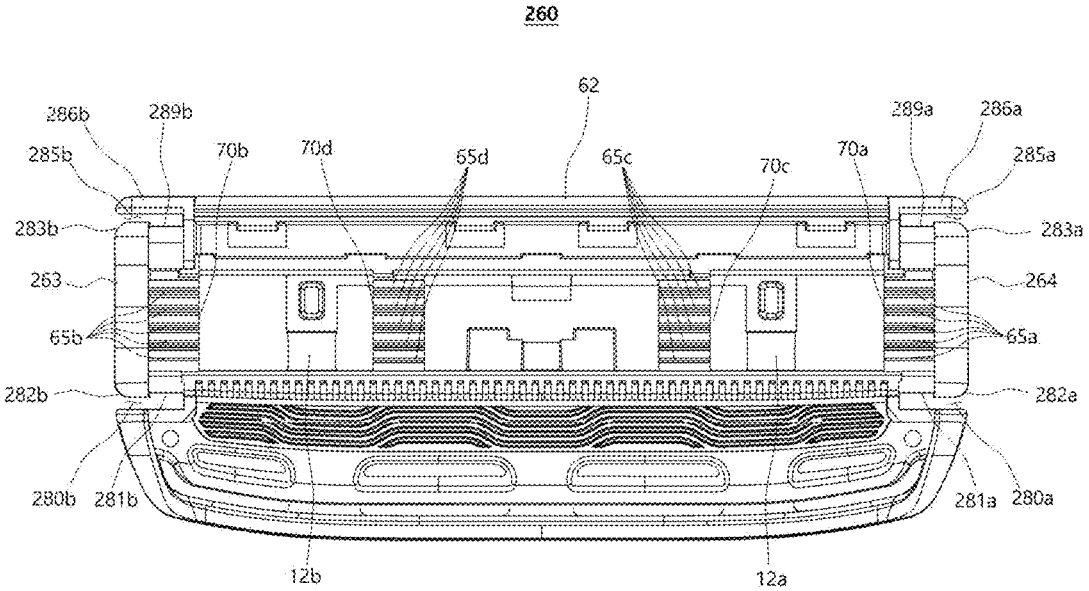
FIG. 10C is a plan view illustrating a blade housing according to the third embodiment of the present disclosure.

FIG. 10C is a plan view illustrating the blade housing 260 according to the third embodiment. Here, the front side slits 280*a* and 280*b* include front accommodating channels 281*a* and 281*b* which are formed to be more concave toward the rear of the blade housing 260 than the positions at which the front side slits 280*a* and 280*b* are open toward the both side ends 264 and 263 of the blade housing 260. Likewise, the rear side slits 285*a* and 285*b* include rear accommodating channels 289*a* and 289*b* which are formed to be more concave toward the front of the blade housing 260 than the positions at which the rear side slits 285*a* and 285*b* are open toward the both side ends 264 and 263 of the blade housing 260. Therefore, the first leg portions 71*a* and 71*b* of the fixing clips 7*a* and 7*b* are bent at the lower surface of the blade housing 260 while surrounding the front accommodating channels 281*a* and 281*b*. In addition, the second leg portions 72*a* and 72*b* of the fixing clips 7*a* and 7*b* are bent at the lower surface of the blade housing 260 while surrounding the rear accommodating channels 289*a* and 289*b*.

In addition, angled surfaces 282*a* and 283*a* or 282*b* and 283*b*, which are tapered from the front accommodating channels 281*a* and 281*b* or the rear accommodating channels 289*a* and 289*b* toward the outside of the both side ends 264 and 263 of the blade housing 260, are formed. Therefore, when the fixing clips 7*a* and 7*b* are inserted, a portion between the two leg portions 71*a* and 72*a* or 71*b* and 72*b* is widened such that seating of the fixing clips 7*a* and 7*b* on the front accommodating channels 281*a* and 281*b* or the rear accommodating channels 289*a* and 289*b* is facilitated.

Figure 7A:
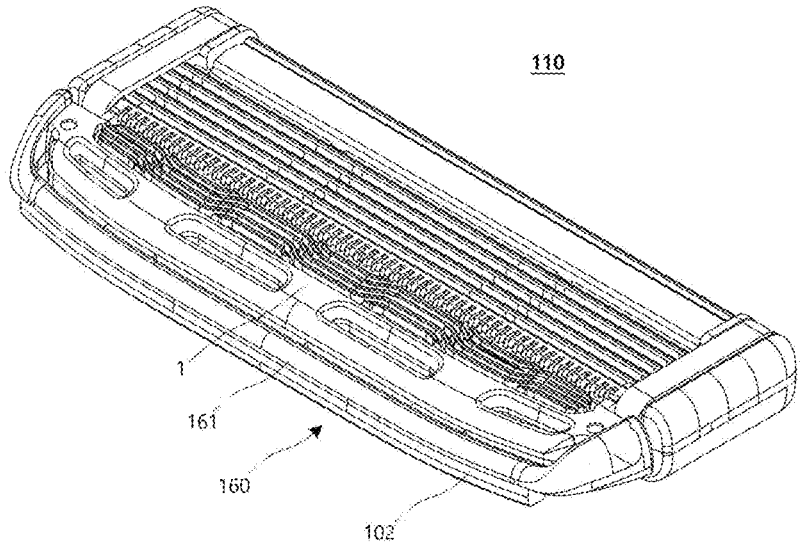
FIG. 7A is a perspective view of a razor cartridge according to a second embodiment of the present disclosure.
Figure 7B:
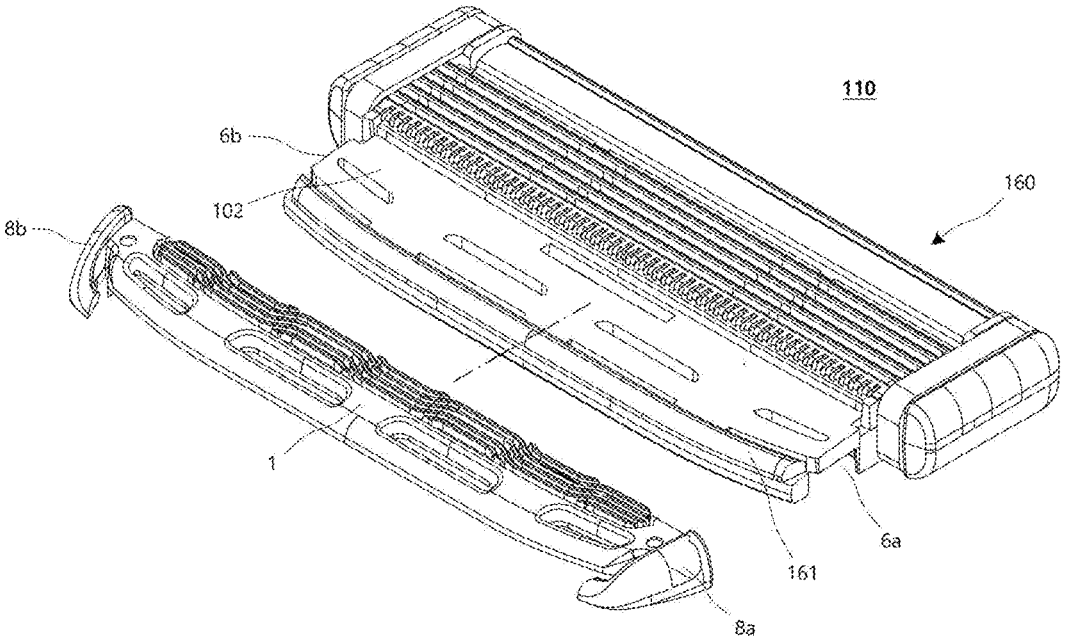
FIG. 7B is a perspective view of a state in which an elastic member is separated from the razor cartridge illustrated in FIG. 7A.
Figure 7C:
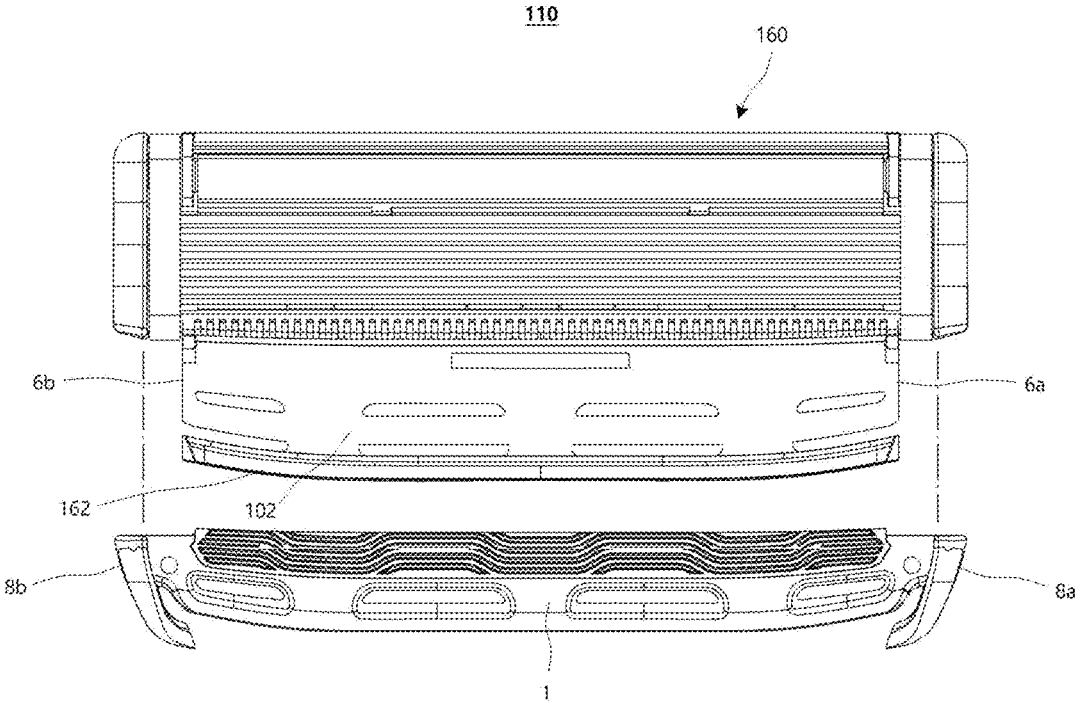
FIG. 7C is a plan view of the state in which the elastic member is separated from the razor cartridge illustrated in FIG. 7A.
Figure 7D:
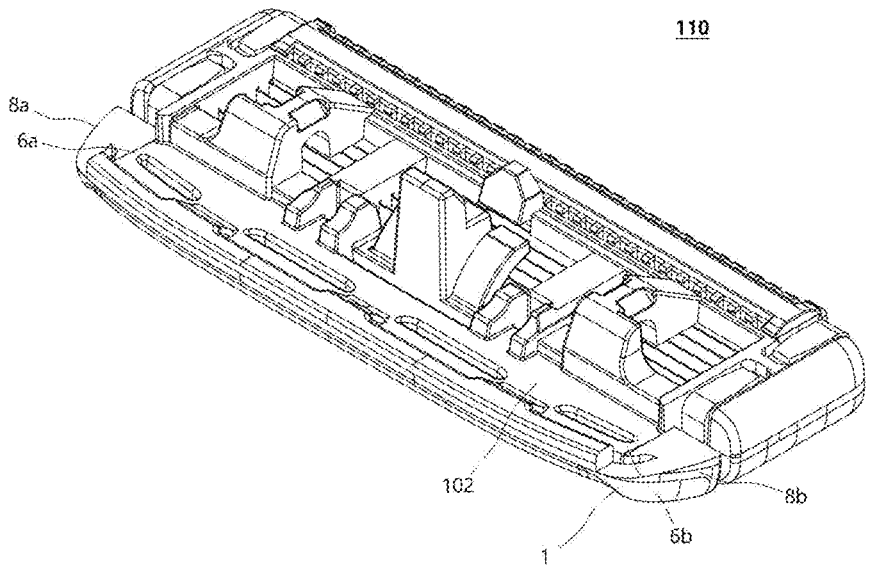
FIG. 7D is a perspective view of the state in which the elastic member is separated from the razor cartridge illustrated in FIG. 7A.

In FIGS. 10A to 10C, the length of the elastic member 1 and the length of a guard bar 202 are illustrated as being substantially the same as each other. However, embodiments are not limited thereto, and as illustrated in FIGS. 7A and 7D which have been described above, the length of the guard bar 202 may be reduced to be within the range between the fixing clips 7*a* and 7*b* while the length of the elastic member 1 is not reduced. In this way, assembly may be facilitated when assembling the fixing clips 7*a* and 7*b* to the blade housing 260, and flexibility may be assigned to both corner sides of a front portion of the blade housing 260 during shaving such that closeness to skin and convenience of shaving may be improved.

Figure 9A:
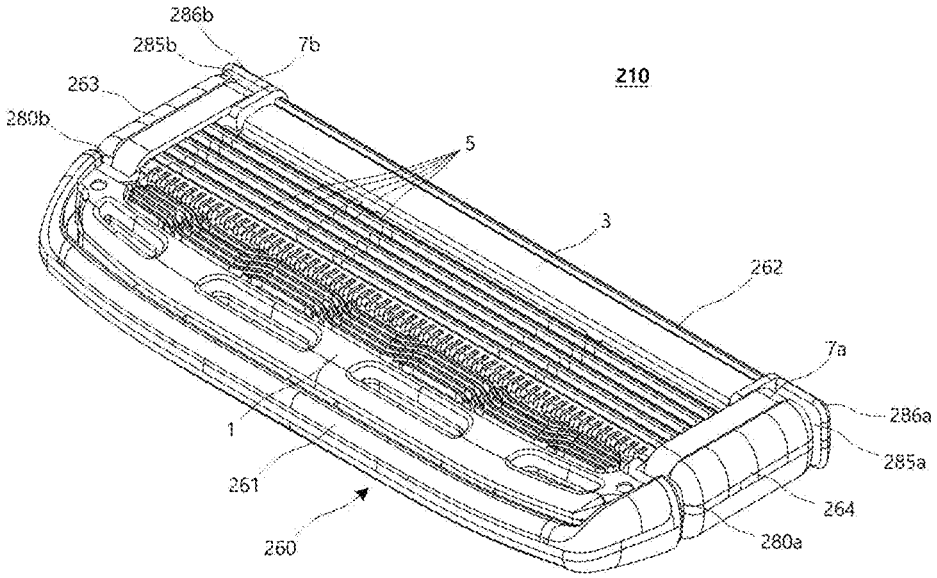
FIG. 9A is a perspective view of a razor cartridge according to a third embodiment of the present disclosure.
Figure 9B:
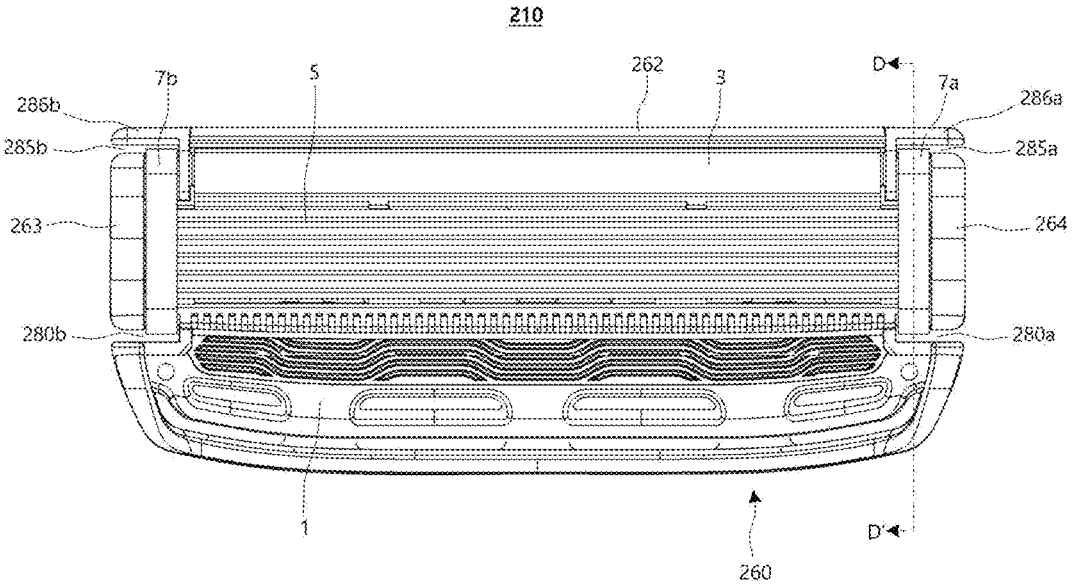
FIG. 9B is a plan view of the razor cartridge illustrated in FIG. 9A.
Figure 9C:
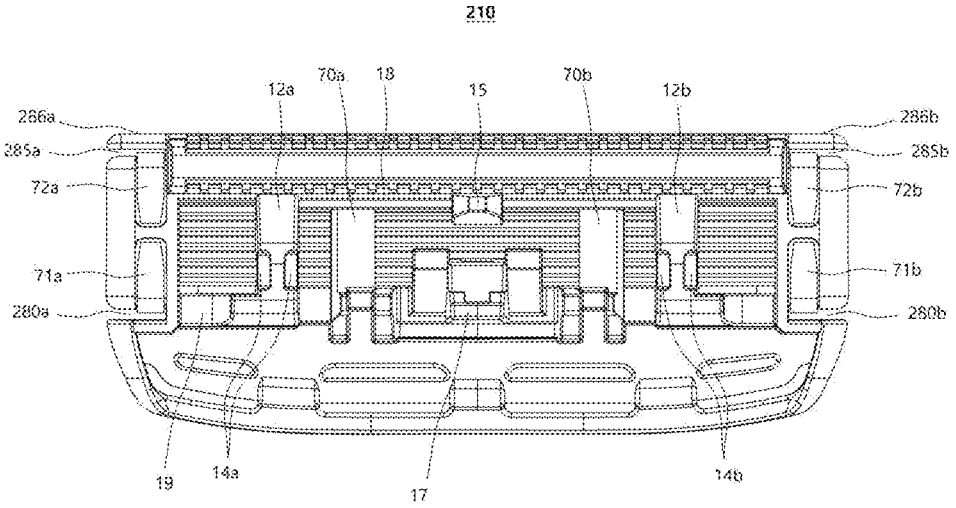
FIG. 9C is a bottom view of the razor cartridge illustrated in FIG. 9A.
Figure 9D:
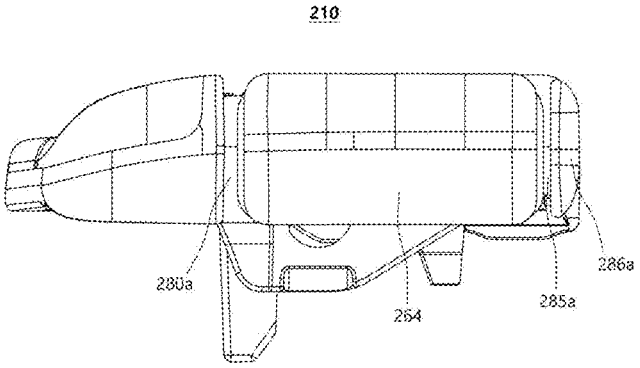
FIG. 9D is a right side view of the razor cartridge illustrated in FIG. 9A.
Figure 11:
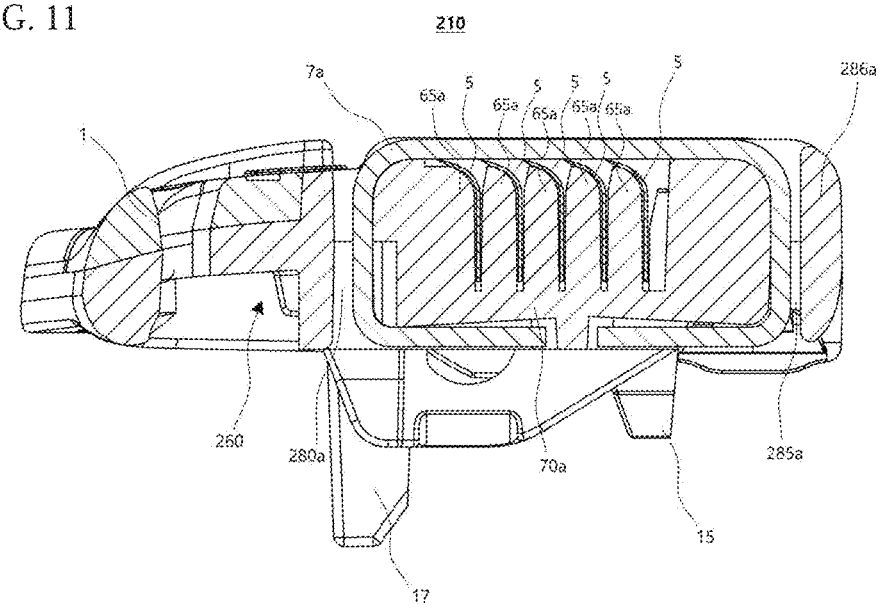
FIG. 11 is a cross-sectional view of the razor cartridge of FIG. 9B taken along line D-D' in FIG. 9B.

FIG. 11 is a cross-sectional view of the razor cartridge 10 of FIG. 9B taken along line D-D' in FIG. 9B. Referring to FIG. 11, five razor blades 5 are inserted into seating slots between seating protrusions 65*a* which are disposed in a row at a longitudinal end member 70*a*. In this case, a cutting edge of the razor blade 5 is pressed by the fixing clip 7*a*, and thus the entire razor blade 5 is firmly supported by the corresponding seating protrusions 65*a*. As illustrated, the fixing clip 7*a* is bent at the lower surface of the blade housing 260 while surrounding both the front accommodating channel 281*a* in the front side slit 280*a* and the rear accommodating channel 289*a* in the rear side slit 285*a*.

As described above, while the side slits 80*a* and 80*b* are disposed only at the front portion of the blade housing 60 in the razor cartridge 10 according to the first embodiment, the front side slits 280*a* and 280*b* and the rear side slits 285*a* and 285*b* are disposed at the front portion and the rear portion, respectively, of the blade housing 260 in the razor cartridge 210 according to the third embodiment. However, embodiments are not limited thereto, and side slits may also be disposed only at the rear portion of the blade housing in the razor cartridge. In this case, the blade housing has a structure in which the first leg portions 71*a* and 71*b* of the fixing clips 7*a* and 7*b* surround the front portion of the blade housing or the wrapping channel formed at the front portion, and as in the third embodiment, the second leg portions 72*a* and 72*b* surround the rear accommodating channels while being accommodated in the rear side slits. However, this embodiment may be more suitable for a blade housing structure in which the front guard bar and the elastic member protrude limitedly rather than for a blade housing structure in which the front guard bar and the elastic member protrude forward much as in the first embodiment or the third embodiment. For example, the razor cartridge according to this embodiment may be understood as having a structure in which the guard bar 202 and the elastic member 1 are removed from the blade housing 260 in the longitudinal direction with respect to the front side slits 280*a* and 280*b* as illustrated in FIGS. 9A and 10A.

Configurations of the razor cartridges 10, 110, and 210 according to embodiments of the present disclosure have been described above. Hereinafter, a razor cartridge assembly 50 including the razor cartridge 10, 110, or 210 and a connector 20 configured to detachably assemble the razor cartridge 10, 110, or 210 to the razor handle 30 will be described in detail. However, since the method of assembling the razor cartridge 10, 110, or 210 to the razor handle 30 using the connector 20 is the same for the razor cartridges 10, 110, and 210, hereinafter, the razor cartridge 10 according to the first embodiment will be described as an example.

Figure 12A:
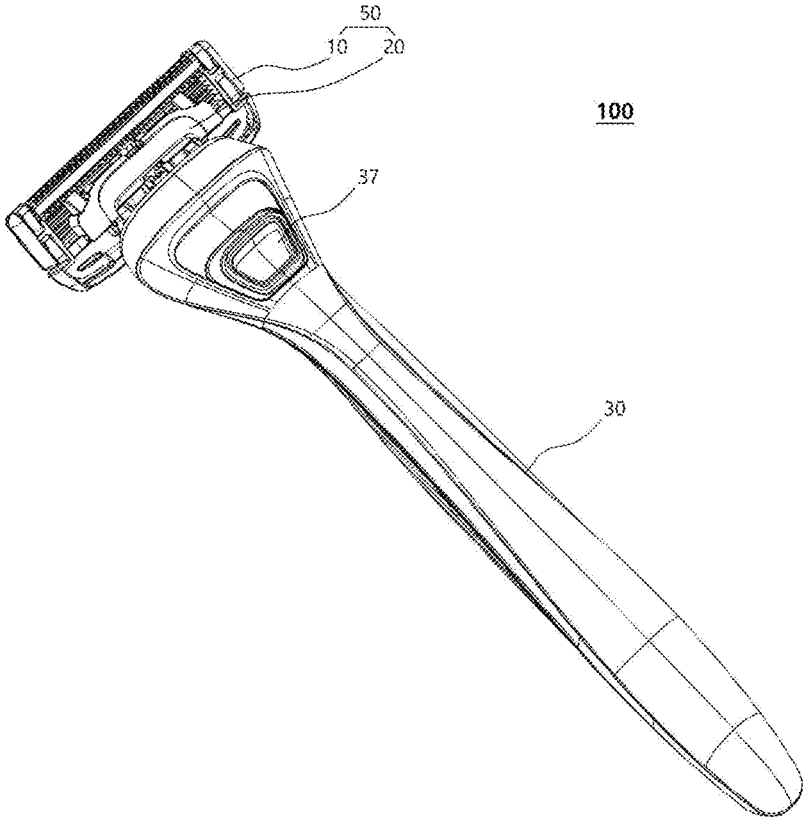
FIG. 12A is a perspective view of a razor according to an embodiment of the present disclosure from a rear surface of a razor handle.
Figure 12B:
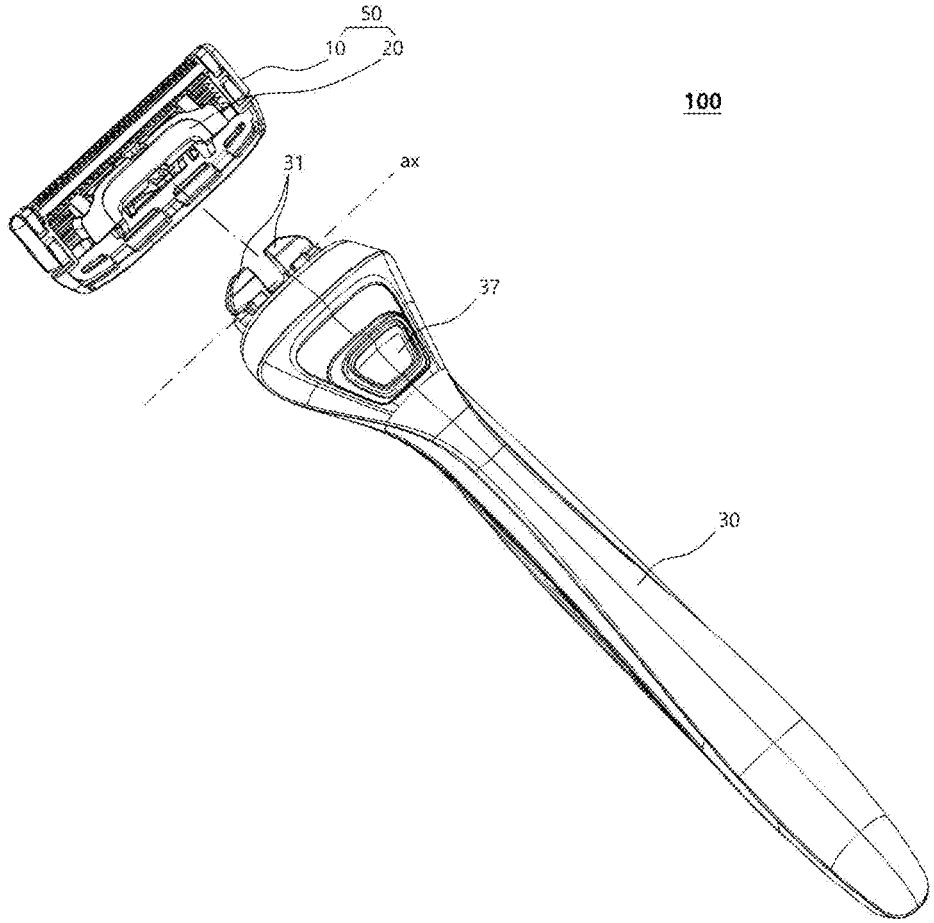
FIG. 12B is a perspective view in which a razor cartridge assembly is separated from the razor handle of FIG. 12A.

FIG. 12A is a perspective view of a razor 100 according to an embodiment of the present disclosure from a rear surface of the razor handle 30 (from a side at which a lower surface of the razor cartridge 10 is visible), and FIG. 12B is a perspective view in which the razor cartridge assembly 50 is separated from the razor handle 30 of FIG. 12A.

The razor 100 according to the embodiment includes the razor cartridge assembly 50 including the razor cartridge 10 and the connector 20, which is fixed and coupled to the razor cartridge 10, and the razor handle 30, which is detachably coupled to the razor cartridge assembly 50. A pair of plunger guards 31 are formed at an end of the razor handle 30, and the plunger guards 31 may be inserted into or detached from a coupling space included in the razor cartridge assembly 50.

In addition, when removing the plunger guards 31 of the razor handle 30 from the razor cartridge assembly 50, a slider button 37 disposed on the rear surface of the razor handle 30 is pushed toward the razor cartridge assembly 50. In this case, a plunger (not illustrated) which is under elastic bias between the pair of plunger guards 31 protrudes toward one side of the razor cartridge assembly 50 and pushes the one side, and accordingly, the plunger guards 31 are detached from the razor cartridge assembly 50.

Meanwhile, the plunger guards 31 may pivot within a predetermined angle range about a rotation axis ax formed in the vicinity of an end of the razor handle 30. Accordingly, when the plunger guards 31 are coupled to the razor cartridge assembly 50, the razor cartridge assembly 50 may also pivot about the rotation axis ax.

Figure 13A:
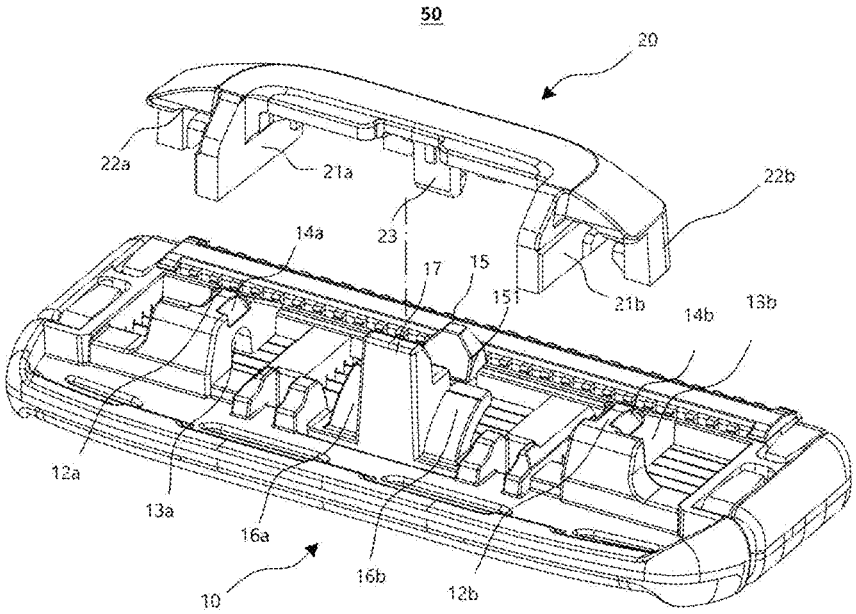
FIGS. 13A and 13B are perspective views in different directions that show the positional relationship between a lower surface of a razor cartridge and a connector before the two are coupled.
Figure 13B:
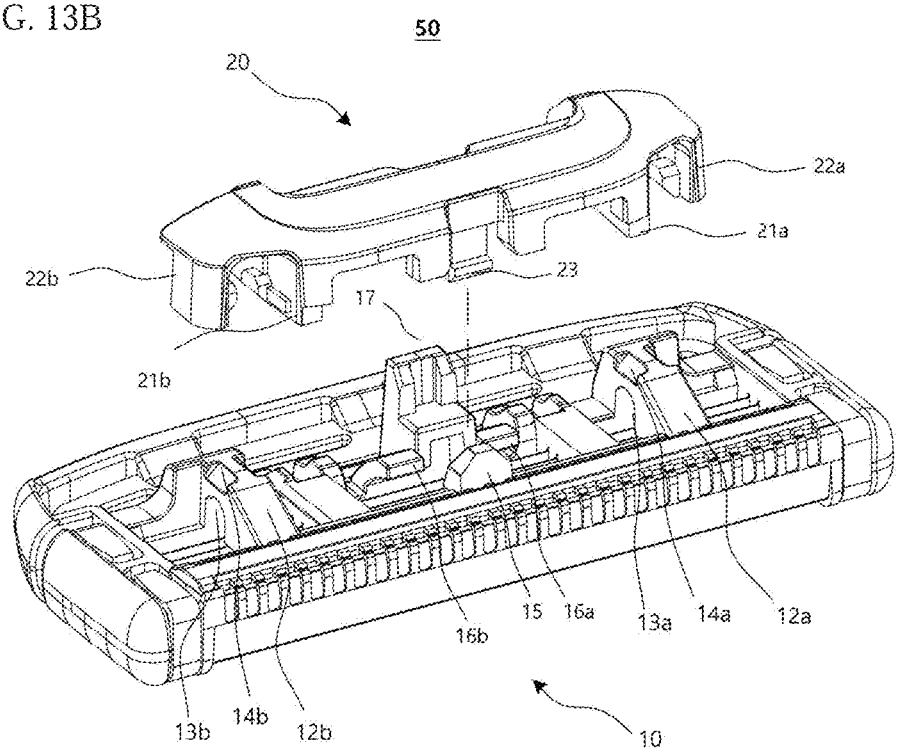

FIGS. 13A and 13B are perspective views in different directions that show the positional relationship between the lower surface of the razor cartridge 10 and the connector 20 before the two are coupled. When the connector 20 is coupled to the lower surface of the razor cartridge 10, a combination of inner cantilevers 21*a* and 21*b* and outer cantilevers 22*a* and 22*b* facing the inner cantilevers 21*a* and 21*b* (hereinafter referred to as inner-outer cantilevers) hold the ribs 12*a* and 12*b* from both sides. In addition, an elastic hook 23 is formed between the two pairs of inner-outer cantilevers in the connector 20 and is coupled to a hook coupling portion 15 formed between the pair of ribs 12*a* and 12*b* at the bottom surface of the razor cartridge 10. In this case, due to the inner-outer cantilevers holding the ribs 12*a* and 12*b* from both sides while an end of the elastic hook 23 is locked to a stepped portion 151 formed inside the hook coupling portion 15, the connector 20 and the razor cartridge 10 are firmly coupled to each other.

Figure 14A:
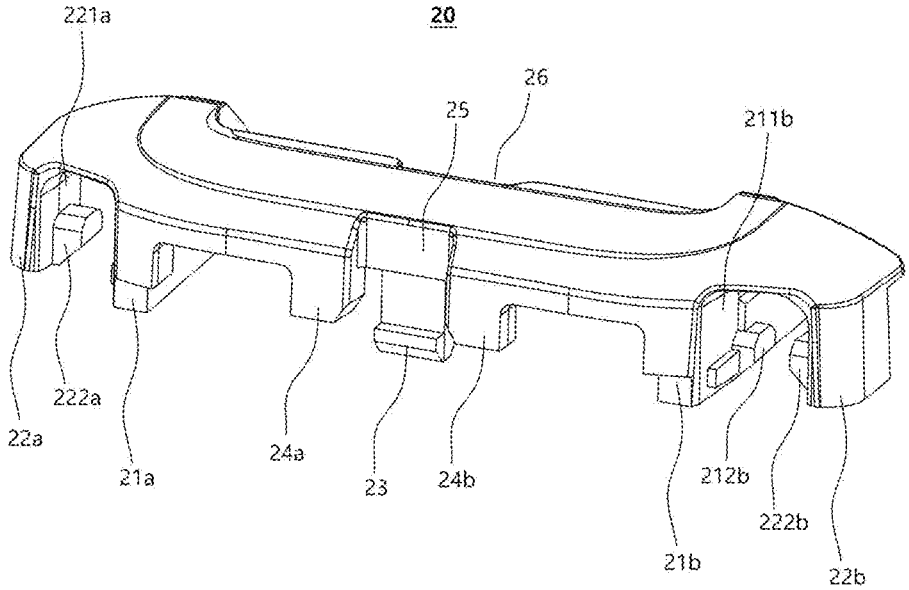
FIGS. 14A, 14B, 14C, and 14D are views for describing a structure of the connector according to an embodiment of the present disclosure in more detail.
Figure 14B:
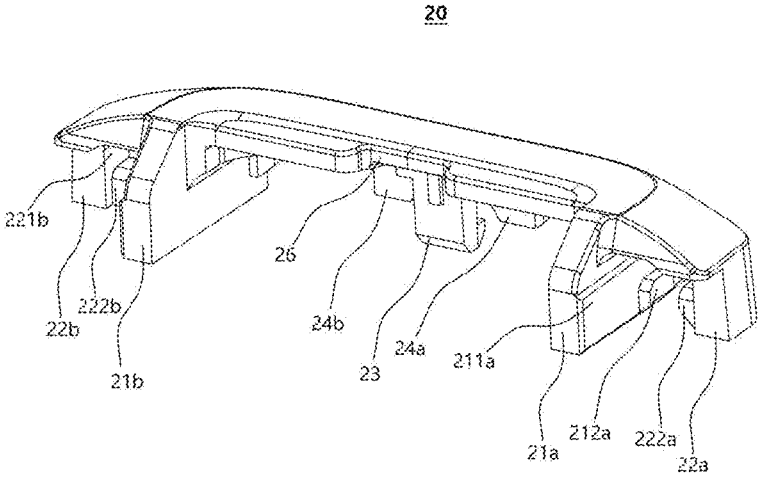
Figure 14C:
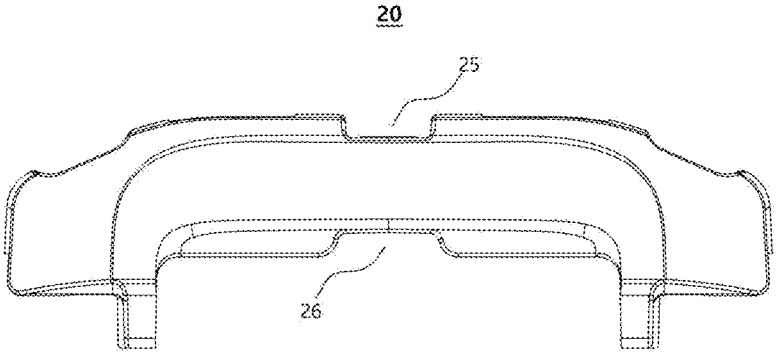
Figure 14D:
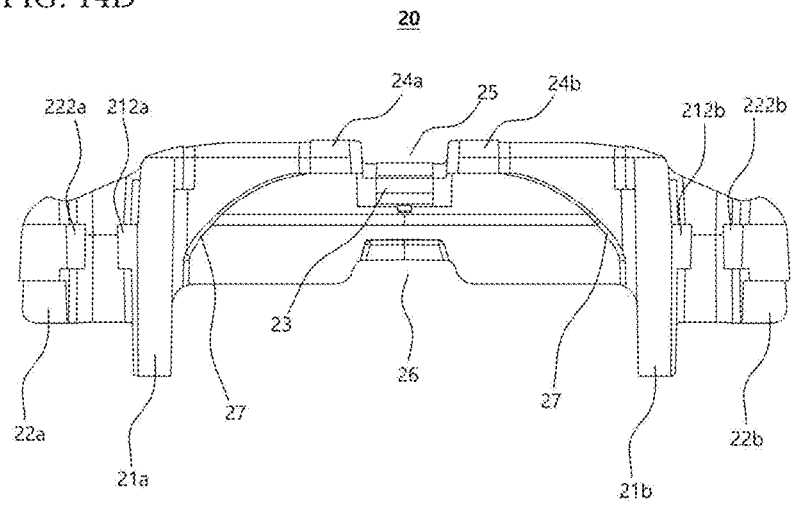

FIGS. 14A to 14D are views for describing a structure of the connector 20 according to an embodiment of the present disclosure in more detail. FIGS. 14A and 14B are perspective views of the connector 20 seen in different directions, and FIGS. 14C and 14D are a plan view and a bottom view, respectively, of the connector 20.

During assembly between the connector 20 and the razor cartridge 10, first, the inner-outer cantilevers 21*a* and 22*a* or 21*b* and 22*b* formed at left and right sides of the connector 20 are engaged to hold the ribs 12*a* and 12*b* formed at corresponding positions of the razor cartridge 10. The connector 20 and the razor cartridge 10 may be firmly assembled just by the above engagement. However, a fine lateral clearance may be generated due to assembly tolerance. Therefore, in an embodiment of the present disclosure, the connector 20 may further include the elastic hook 23 that is able to be coupled to the hook coupling portion 15 of the razor cartridge 10 at a position corresponding to the hook coupling portion 15. In this case, since an end of the elastic hook 23 that may be bent by a cantilever beam structure is locked to the stepped portion 151 formed inside the hook coupling portion 15, the clearance problem can be effectively solved, and firmer coupling may be guaranteed between the connector 20 and the razor cartridge 10.

In addition, the connector 20 may include a pair of stepped portions 24*a* and 24*b* that are formed near the elastic hook 23 and are configured to guide the hook coupling portion 15 so that the elastic hook 23 and the hook coupling portion 15 are coupled to each other at correct positions. The stepped portions 24*a* and 24*b* may have vertically symmetrical shapes with respect to the elastic hook 23, and a guide slot 25, which is a space in which the hook coupling portion 15 may move while being guided, is formed between the two stepped portions 24*a* and 24*b*.

Meanwhile, at the opposite side of the guide slot 25, a clearance groove 26, which is disposed at a predetermined interval y from a central bar 17 of the razor cartridge 10 during assembly of the razor cartridge 10 and the connector 20, is formed. When the plunger (not illustrated) of the razor handle 30 protrudes, the central bar 17 is pushed while being elastically deformed to some extent in a direction opposite from the plunger. In this case, the clearance groove 26 provides a space in which the pushed central bar 17 may be bent while having slight elasticity.

Meanwhile, referring to FIG. 14D, a recess portion 27 which has substantially an arc shape is formed in an inner surface of the connector 20. The recess portion 27 has a profile that matches an outer shape of the pair of plunger guards 31 (see FIGS. 16A to 16C) formed at a proximal end of the razor handle 30.

Figure 15:
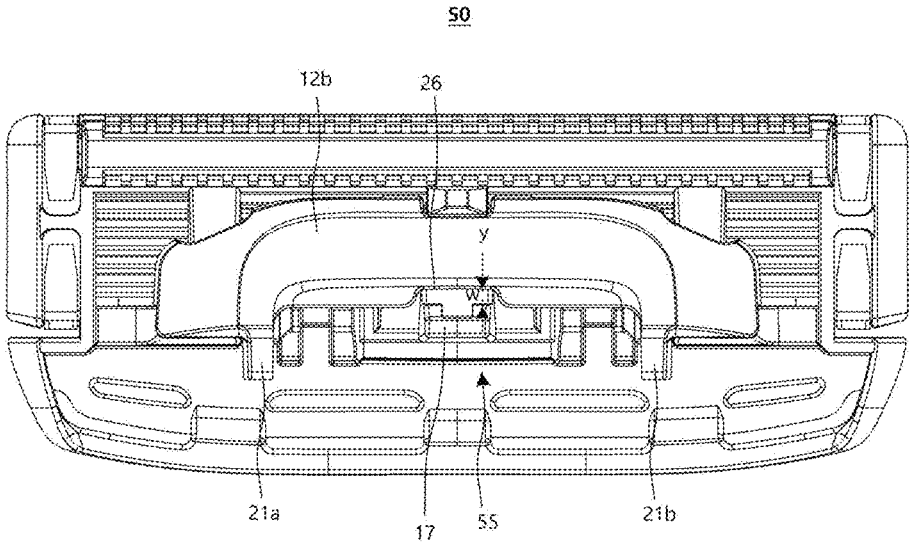
FIG. 15 is a bottom view of a razor cartridge assembly according to an embodiment of the present disclosure.

FIG. 15 is a bottom view of an assembly of the connector 20 and the razor cartridge 10, that is, the razor cartridge assembly 50.

While the razor cartridge 10 and the connector 20 are assembled as described above, an engagement space 55 into which the proximal end of the razor handle 30 may be inserted toward the front portion of the razor cartridge 10 is formed between the razor cartridge 10 and the connector 20. In this case, the inner cantilevers 21*a* and 21*b* form both side ends of the engagement space 55 in the direction d. In addition, the engagement space 55 is divided into two areas by the central bar 17 of the razor cartridge 10, and the pair of plunger guards 31 may be respectively inserted into the two areas.

When causing the razor handle 30 to be separated from the razor cartridge assembly 50 in the above-described assembly state, the plunger (not illustrated) of the razor handle 30 protrudes due to a user's manipulation. Therefore, the plunger pushes the central bar 17, and the pair of plunger guards 31 retreat from the engagement space 55 and are separated therefrom. In this case, the central bar 17 that is pushed by the plunger may be bent within a predetermined interval y range while having slight elasticity.

FIG. 16A is an exploded perspective view of the razor 100 according to an embodiment of the present disclosure, FIG. 16B is a side view of the exploded perspective view of FIG. 16A, and FIG. 16C is a plan view of the exploded perspective view of FIG. 16A.

As described above, after the razor cartridge 10 and the connector 20 are assembled such that the razor cartridge assembly 50 is formed, the pair of plunger guards 31 may be detachably coupled to the engagement space 55 formed in the razor cartridge assembly 50. The engagement space 55 may be divided into two areas by the central bar 17, and the pair of plunger guards 31 may be respectively inserted into the two areas. That is, when the pair of plunger guards 31 are inserted into the engagement space 55, the central bar 17 supports a space between the pair of plunger guards 31.

The plunger guards 31 may be disposed at a proximal end side of a cartridge mounter 35 that is separately disposed to be able to be coupled to a handle grip 39, and the plunger guards 31 may pivot within a predetermined angle range about the rotation axis ax that is parallel with the direction d of the razor. Therefore, while shaving is performed, the razor cartridge assembly 50 which is coupled to the plunger guards 31 may also pivot about the rotation axis ax according to the user's manipulation. A coupling member 33 is formed at an end side of the cartridge mounter 35 so that the cartridge mounter 35 may be coupled to a proximal end side of the handle grip 39. Of course, unlike the above, the cartridge mounter 35 may also be integrally formed with the handle grip 39 instead of being manufactured as a separate element and coupled to the handle grip 39.

Meanwhile, the slider button 37 is formed at one side of the cartridge mounter 35. The user may cause the plunger (not illustrated) to protrude by pushing the slider button 37 upward toward the razor cartridge assembly 50. As illustrated in FIG. 16A, the pair of plunger guards 31 are disposed at the proximal end of the cartridge mounter 35, and a plunger is formed to be inserted or withdrawn between the pair of plunger guards 31. In this case, the plunger is at a position at which it does not protrude to the outside when there is no external force, and then when the user pushes the slider button 37 upward toward the razor cartridge assembly 50, the plunger protrudes toward the razor cartridge assembly 50 from between the two plunger guards 31. Due to the plunger, which protrudes as above, pushing the central bar 17 (see FIG. 13B), the plunger guards 31, which have been coupled to the engagement space 55, are detached from the razor cartridge assembly 50.

According to the razor cartridge according to an embodiment of the present disclosure, there is an advantage in that, while a sufficient width of a guard bar of a front end of a blade housing can be secured, razor blades can be firmly fixed on the blade housing by fixing clips.

According to the razor cartridge according to an embodiment of the present disclosure, there is an advantage in that problems in that a degree of precision of an injection process has to be increased and complexity of a mold structure is increased in order to form a fine through-hole in the blade housing can be solved.

According to the razor cartridge according to an embodiment of the present disclosure, there is an advantage in that a defect problem of a blade housing that is caused due to improper injection of a closed side end of the blade housing in which the through-hole is formed can be prevented.

According to the razor cartridge according to an embodiment of the present disclosure, since the fixing clips can be assembled from an upper portion of the blade housing or can also be assembled from the outside toward the inside, the degree of freedom of assembly can be secured.

In addition, according to the razor cartridge according to an embodiment of the present disclosure, in comparison to a structure in which the fixing clips are inserted into the through-hole formed in the blade housing as in the conventional case, fixing clips having various thicknesses or lengths can be used alternately.

Embodiments of the present disclosure have been described above with reference to the accompanying drawings, but those of ordinary skill in the art to which the present disclosure pertains should understand that the present disclosure may be practiced in other specific forms without changing the technical idea or essential features thereof. Therefore, the embodiments described above are illustrative in all aspects and should not be understood as limiting.

What is claimed is:

1. A razor cartridge comprising: at least one razor blade having a cutting edge; a blade housing configured to accommodate the at least one razor blade in a longitudinal direction, which is perpendicular to a shaving direction, the blade housing having an upper surface and a lower surface opposite and parallel to the upper surface, and two side ends which connect the upper surface to the lower surface; and a pair of fixing clips configured to secure both ends of the at least one razor blade to be seated in the blade housing, wherein: the blade housing includes a pair of side slits which are disposed at a forward position with respect to the at least one razor blade and each of the pair of side slits is configured to be open at a corresponding one of the side ends of the blade housing; each of the pair of side slits is open from the upper surface of the blade housing to the lower surface of the blade housing; and each of the pair of fixing clips includes a first leg portion and a second leg portion, wherein for each of the fixing clips, the corresponding first leg portion is accommodated in a corresponding side slit of the pair of side slits and the corresponding second leg portion is wrapped around a rear end of the blade housing.

2. The razor cartridge of claim 1, further comprising a pair of wrapping channels at the rear end of the blade housing, wherein the corresponding second leg portion is bent at the lower surface of the blade housing while being accommodated in a corresponding wrapping channel of the pair of wrapping channels.

3. The razor cartridge of claim 2, wherein the fixing clips are installed into the pair of side slits and the pair of wrapping channels in a downward direction into the blade housing.

4. The razor cartridge of claim 2, wherein on at least one of the upper surface or the lower surface of the blade housing, a pair of guide recesses are formed to extend respectively between the pair of side slits and the pair of wrapping channels in order to guide seating of the pair of fixing clips.

5. The razor cartridge of claim 1, wherein:

each of the pair of side slits includes an outer channel open at the side end and an accommodating channel that is extended inward from the outer channel;

one side of the accommodating channel is closer to the rear end of the blade housing than a corresponding side of the outer channel is to the rear end of the blade housing; and the first leg portion is positioned within the accommodating channel at the lower surface of the blade housing.

6. The razor cartridge of claim 1, further comprising a guard bar disposed in front of the at least one razor blade.

7. The razor cartridge of claim 6, further comprising an elastic member disposed in front of the at least one razor blade and at an upper side of the guard bar.

8. The razor cartridge of claim 1, further comprising:

a guard bar formed in front of the razor blade and having a length greater than a distance between the pair of fixing clips; and an elastic member having substantially a same length as the guard bar and disposed at an upper side of the guard bar.

9. The razor cartridge of claim 1, further comprising a trimmer blade separately disposed from the at least one razor blade and a trimmer cap configured to secure the trimmer blade disposed at the rear end of the blade housing, wherein the second leg portion is configured to secure the trimmer cap as the second leg portion is wrapped around the rear end of the blade housing.

10. The razor cartridge of claim 1, further comprising a connector configured to be coupled to the blade housing, wherein the connector is further configured to be detachably coupled to a razor handle, wherein:

the blade housing further includes a pair of ribs configured to support the blade housing and aligned in the shaving direction; and the connector includes corresponding inner cantilevers and outer cantilevers facing each other in the longitudinal direction, wherein the blade housing and the connector are coupled to each other by the pair of ribs being secured between the corresponding inner cantilevers and outer cantilevers.

11. The razor cartridge of claim 1, wherein:

the blade housing has two longitudinal sides that are parallel along the longitudinal direction and two lateral sides that are parallel along the shaving direction; and each of the pair of side slits is configured to be open at the side end formed at a corresponding one of the two lateral sides.

12. The razor cartridge of claim 1, wherein the pair of the side slits are open along the longitudinal direction such that an imaginary linear line runs through the pair of side slits.

13. The razor cartridge of claim 1, wherein a first opening and a second opening of the pair of side slits are formed in the longitudinal direction such that the first opening and the second opening are perpendicular to the shaving direction along which the pair of fixing clips are extended to secure the both ends of the at least one razor blade.

14. The razor cartridge of claim 7, wherein a length of the guard bar is less than a distance between the pair of fixing clips.

15. The razor cartridge of claim 14, wherein a length of the elastic member is greater than the distance between the pair of fixing clips.

16. The razor cartridge of claim 5, wherein:

at least one of two sides of the outer channel is slanted such that the two sides are not parallel; and two sides of the accommodating channel are parallel.

17. The razor cartridge of claim 16, wherein a distance between the two sides of the accommodating channel is greater than a distance between the two sides of the outer channel.

* * * * *